US007027911B2

(12) United States Patent
Nishikawa et al.

(10) Patent No.: US 7,027,911 B2
(45) Date of Patent: Apr. 11, 2006

(54) APPARATUS FOR CONTROLLING ENGINE ROTATION STOP BY ESTIMATING KINETIC ENERGY AND STOP POSITION

(75) Inventors: Seiichirou Nishikawa, Okazaki (JP); Yoshifumi Murakami, Obu (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/761,189

(22) Filed: Jan. 22, 2004

(65) Prior Publication Data

US 2004/0149251 A1 Aug. 5, 2004

(30) Foreign Application Priority Data

Jan. 30, 2003 (JP) ..... 2003-021562
Feb. 13, 2003 (JP) ..... 2003-034579
Feb. 13, 2003 (JP) ..... 2003-034580

(51) Int. Cl.
*G06G 7/70* (2006.01)

(52) U.S. Cl. ..... 701/112; 701/100; 701/113; 701/114; 123/198 DB; 123/198 C

(58) Field of Classification Search ..... 701/100, 701/112, 113, 114; 123/247, 198 DB, 198 C; 60/415; 73/1.29
See application file for complete search history.

(56) References Cited

U.S. PATENT DOCUMENTS 6,684,154 B1 * 1/2004 Isobe et al. ..... 701/114
6,832,151 B1 * 12/2004 Kumazaki et al. ..... 701/112

FOREIGN PATENT DOCUMENTS

JP 60-240875 11/1985
JP 11-107823 4/1999
JP 2001-82204 3/2001

* cited by examiner

*Primary Examiner*—Tony M. Argenbright
*Assistant Examiner*—Johnny H. Hoang
(74) *Attorney, Agent, or Firm*—Nixon & Vanderhye P.C.

(57) ABSTRACT

A control apparatus for an engine increases an intake air quantity just before engine stop to increase a compression pressure in a compression stroke. As the compression pressure is increased, a negative torque in the compression stroke increases and obstructs engine rotation, and brakes the engine rotation. Thus, a range of crank angle, in which torque is below engine friction, that is, in which engine rotation can be stopped, is reduced. As a result, variation in engine rotation stop position is reduced to be within a small range of crank angle. Information of engine rotation stop position is stored, and the stored information of engine rotation stop position is used at the start of an engine to accurately determine an initial injection cylinder and an initial ignition cylinder to start the engine.

15 Claims, 24 Drawing Sheets

| | | | | |
|---|---|---|---|---|
| #1 | SUC | COM | EXP | EXH |
| #3 | EXH | SUC | COM | EXP |
| #4 | EXP | EXH | SUC | COM |
| #2 | COM | EXP | EXH | SUC |

APPARATUS FOR CONTROLLING ENGINE ROTATION STOP BY ESTIMATING KINETIC ENERGY AND STOP POSITION

CROSS REFERENCE TO RELATED APPLICATION

This application is based on and incorporates herein by reference Japanese Patent Applications No. 2003-21562 filed on Jan. 30, 2003, No. 2003-34579 filed on Feb. 13, 2003 and No. 2003-34580 filed on Feb. 13, 2003.

FIELD OF THE INVENTION

The present invention relates to an apparatus for controlling engine rotation stop, estimating a rotation stop position and estimating kinetic energy.

BACKGROUND OF THE INVENTION

Generally, ignition control and fuel injection control are performed in engine operation by determining cylinders on the basis of output signals from a crank angle sensor and a cam angle sensor and detecting a crank angle. However, a cylinder for initial ignition/injection is not known at the start of an engine until the engine is cranked by a starter and determination of a specified cylinder is completed, that is, a signal of a predetermined crank angle of the specified cylinder is detected.

In order to solve such a problem, as disclosed in patent document 1 (JP-A-60-240875), a starting quality and exhaust emission at the start are improved by storing a crank angle (a stop position of a crankshaft) at the time of engine rotation stop in a memory, and starting ignition control and fuel injection control on the basis of a crank angle at the time of engine rotation stop, which is stored in the memory, at a subsequent engine start until a signal of a predetermined crank angle of a specified cylinder is initially detected.

Since an engine is rotated by inertia for some time after an ignition switch is turned off (operated to OFF position) to stop ignition and fuel injection, a crank angle at an actual engine rotation stop (at a subsequent engine start) is erroneously determined in the case where a crank angle at the time of OFF-operation of an ignition switch is stored. Accordingly, it is necessary to maintain an electric source of a control system in an ON state to continue detection of a crank angle until engine rotation is completely stopped even after the ignition switch is turned off. However, a crank angle at the time of engine rotation stop cannot be exactly detected since a phenomenon, in which engine rotation is reversed by a compression pressure in a compression stroke, is generated just before engine rotation is stopped (reverse rotation cannot be detected).

Also, as disclosed in patent document 2 (JP-A-11-107823), an initial injection cylinder and an initial ignition cylinder at a subsequent engine start are determined by estimating a cylinder, into which fuel is injected just before an ignition switch is turned off, and an engine rotation stop position on the basis of an operating state at that time, and determining an initial position of a crankshaft at a subsequent engine start from the estimated stop position.

Engine rotation is stopped at a position (a position of torque=0), in which a negative torque in a compression stroke and a positive torque in an expansion stroke of other cylinders balance each other, at the time of engine rotation stop provided that no friction is present in an engine. However, engine friction is actually present to cause a stop position to vary in a relatively wide range of crank angle, in which torque is below engine friction. Therefore, with the technique of patent document 2, it is difficult to accurately estimate an engine rotation stop position, with the result that there is a possibility of erroneously determining an initial injection cylinder and an initial ignition cylinder at the time of engine starting. Thus, it is difficult to improve a starting operation and exhaust emission at the start.

Also, with patent document 2, an initial cylinder in successive injection at a subsequent engine start is estimated by calculating rotation (TDC number) until a crankshaft is rotated by inertia to be stopped, on the basis of an engine operating state (intake pipe pressure, engine rotational speed) at the moment when an ignition switch is turned off, and estimating an engine rotation stop position from a cylinder, into which fuel is injected just before an ignition switch is turned off, and rotation (TDC number) until the stoppage.

Since according to patent document 2, only kinetic energy of inertia of an engine is previously subjected to matching to be stored and variation in kinetic energy is not predicted in the course of stop, variation due to fabrication tolerance of engines, changes with the passage of time, and changes in engine friction (for example, a difference in viscosity due to temperature change of an engine oil) causes a possibility that rotation (TDC number) until a crankshaft is rotated by inertia to be stopped is erroneously estimated. Therefore, with patent document 2, it is difficult to accurately estimate an engine rotation stop position, with the result that an initial injection cylinder and an initial ignition cylinder at the time of engine starting are erroneously determined to worsen a starting quality and exhaust emission at the start.

Further, in order to perform control conforming to an operation condition in internal combustion engines, it is necessary to grasp a quantity of kinetic energy, which an internal combustion engine has. Conventionally, an engine rotational speed is widely used in engine control as a value representative of kinetic energy. According to, for example, patent document 2 (JP-A-11-107823), rotation (TDC number) until a crankshaft is rotated by inertia to be stopped is calculated on the basis of an engine operating state (intake pipe pressure, engine rotational speed) at the moment when an ignition switch is turned off, and an initial cylinder in successive injection at a subsequent engine start is estimated from a cylinder, into which fuel is injected just before the ignition switch is turned off, and rotation (TDC number) until the stoppage.

Also, according to patent document 3 (JP-A-2001-82204), it is determined during execution of fuel cut-off in deceleration whether an engine can be driven by an electric motor (motor/generator or the like) at a rotational speed higher by a predetermined speed ÄNe than a normal rotational speed Ne1 for a fuel supply return from the fuel cut-off. In the case where driving is possible, the fuel return rotational speed is set to a low rotational speed Ne2 to improve fuel consumption, and in the case where driving is not possible, the fuel return rotational speed is set to the normal fuel return rotational speed Ne1.

According to patent document 2, however, kinetic energy of inertia of an engine is previously subjected to hing to be stored and variation in kinetic energy is not predicted in the course of stop, in the same manner as in patent document 2. Accordingly, variation due to changes in engine friction (for example, a difference in viscosity due to temperature change of an engine oil) causes a possibility that rotation (TDC number) until a crankshaft is rotated by inertia to be stopped is erroneously estimated. Besides, in the case where deviation from a constant subjected to matching is generated due to changes with the passage of time, or the like, correction cannot be made.

Also, according to the disclosure of patent document 3, only a fuel supply return rotational speed is prepared as a determination condition of fuel return but variation in rotational speed, that is, variation in kinetic energy is not predicted. Accordingly, a fuel supply return rotational speed is set to a rather high level as means for avoiding engine stall. Thus, an effect of fuel consumption must be sacrificed.

SUMMARY OF THE INVENTION

It is a first object of the present invention to enable reducing variation in engine rotation stop position and accurately finding information of engine rotation stop position, that is, information of an initial position of a crankshaft at the time of engine starting, thereby improving a starting quality and exhaust emission at the start.

In order to attain the first object, according to the present invention, engine rotation is stopped by increasing a compression pressure in a compression stroke when engine rotation is to be stopped. In this manner, when a compression pressure in a compression stroke is increased at the time of engine rotation stop, a negative torque generated in the compression stroke is increased to serve as forces for obstructing engine rotation, whereby engine rotation is braked and a range of crank angle (a range of crank angle, in which engine rotation can be stopped), in which torque is below engine friction, is made smaller than a conventional one, and in which range of crank angle engine rotation is stopped. Thereby, variation in engine rotation stop position can come within a smaller range of crank angle than a conventional one, so that information of engine rotation stop position (information of an initial position of a crankshaft at the time of engine starting) can be accurately found, thereby enabling improving a starting quality and exhaust emission at the start.

It is a second object of the present invention to accurately estimate an engine rotation stop position to improve a starting quality and exhaust emission at the start.

In order to attain the second object, according to the present invention, ignition and/or fuel injection is stopped on the basis of an engine stop command to stop engine rotation to calculate a parameter representative of engine operations and to calculate a parameter for obstructing engine operations. An engine rotation stop position is estimated in the course of engine rotation stop on the basis of the parameter representative of engine operations and the parameter for obstructing engine operations. In this case, in the course of calculating the parameter representative of engine operations and the parameter for obstructing engine operations, it is possible to take account of variation due to fabrication tolerance of engines, changes with the passage of time, and changes in engine friction (for example, a difference in viscosity due to temperature change of an engine oil). Therefore, an engine rotation stop position can be estimated from these parameters more accurately than in a conventional art to improve a starting quality and exhaust emission at the start as compared with the conventional art.

It is a third object of the present invention to accurately estimate a future kinetic energy, which an internal combustion engine has.

In order to attain the third object, a present kinetic energy of an internal combustion engine is calculated, a work load for obstructing motions of the internal combustion engine is calculated, and a future kinetic energy is estimated on the basis of a present kinetic energy and a work load, which have been calculated. Since kinetic energy of an internal combustion engine is consumed by a work load, which acts to obstruct motions thereof, a future kinetic energy can be estimated by calculating a present kinetic energy of an internal combustion engine and a work load for obstructing the motions.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT (First Embodiment)

Figure 1:
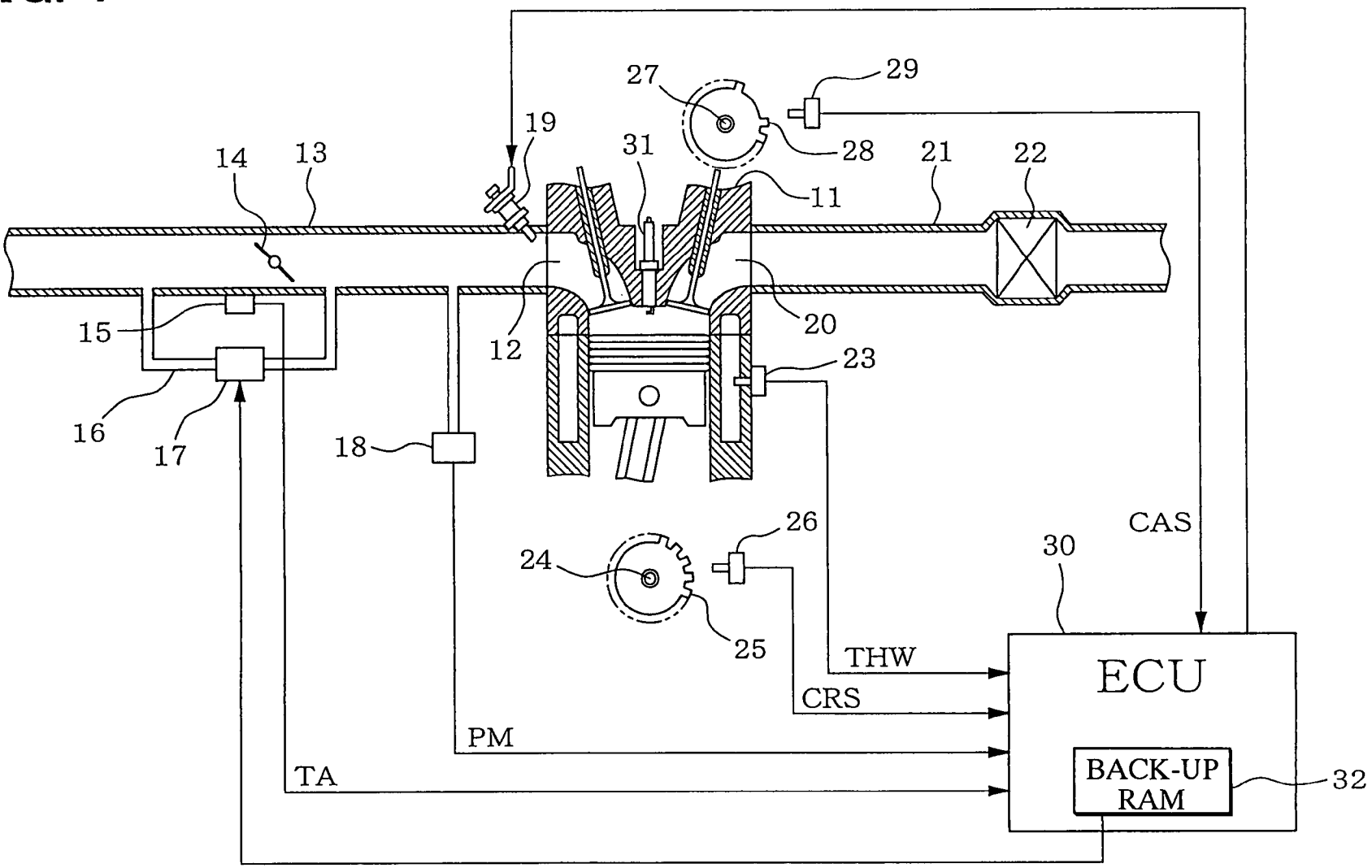
FIG. 1 is a schematic diagram showing an engine control system in a first embodiment of the present invention.

Referring first to FIG. 1, a throttle valve 14 is provided midway in an intake pipe 13 connected to intake ports 12 of an engine 11, and an opening degree (throttle opening degree) TA of the throttle valve 14 is detected by a throttle opening degree sensor 15. Provided in the intake pipe 13 is a bypass passage 16 to bypass the throttle valve 14, and provided midway the bypass passage 16 is an idling speed control valve (ISC valve) 17. Provided on the downstream side of the throttle valve 14 is an intake pipe pressure sensor 18 for detecting an intake pipe pressure PM, and mounted in the vicinity of the intake ports 12 of respective cylinders are fuel injection valves 19.

Figure 5:
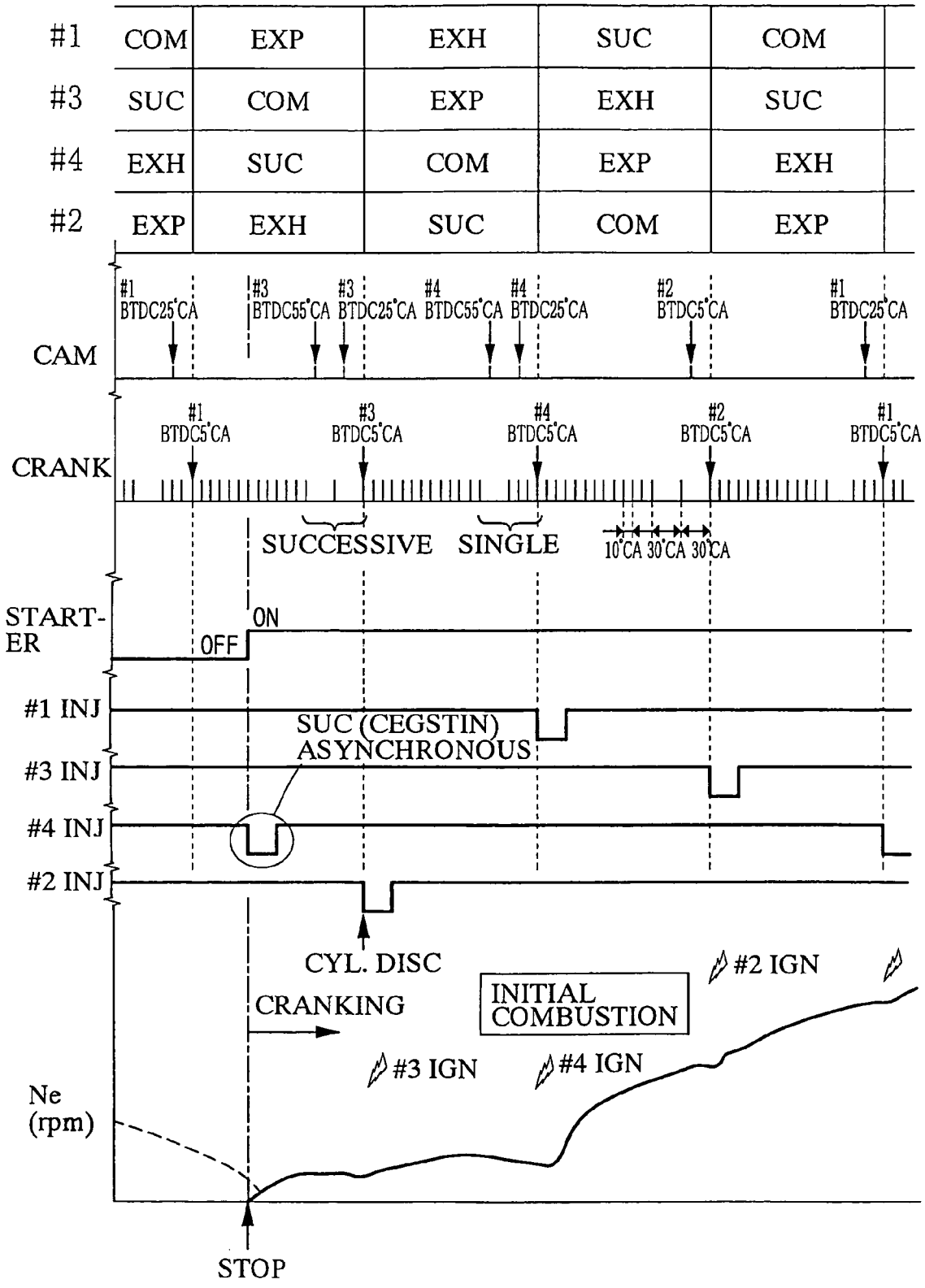
FIG. 5 is a time chart illustrating an example of fuel injection control at the engine start.

A catalyst 22 for purification of exhaust gases is installed midway in an exhaust pipe 21 connected to exhaust ports 20 of the engine 11. Provided on a cylinder block of the engine 11 is a cooling water temperature sensor 23 for detecting a cooling water temperature THW. A crank angle sensor 26 is installed to face an outer periphery of a signal rotor 25 mounted on a crankshaft 24 of the engine 11, and the crank angle sensor 26 outputs a crank angle signal CRS every rotation of a predetermined crank angle (for example, 10° CA) in synchronism with rotation of the signal rotor 25. Also, a cam angle sensor 29 is installed to face an outer periphery of a signal rotor 28 mounted on a cam shaft 27 of the engine 11, and the cam angle sensor 29 outputs a cam angle signal CAS at a predetermined cam angle in synchronism with rotation of the signal rotor 28 (FIG. 5).

Outputs of these various sensor are input into an electronic engine control unit (ECU) 30. The ECU 30 is mainly composed of a microcomputer to control fuel injection quantities and fuel injection timings of the fuel injection valves 19, ignition timings of ignition plugs 31, a bypass air quantity of the ISC valve 17 according to an engine operation state detected by various sensors, and so on to function as engine control means.

In the embodiment, the ECU 30 functions as stop-time compression pressure increase control means for increasing a bypass air quantity (intake air quantity) passing through the ISC valve 17 just before the stop of engine rotation to increase compression pressure in a succeeding compression stroke, and also as engine control means for storing information of an engine rotation stop position at this time in a rewritable, nonvolatile memory (storage means) such as a backup RAM 32 or the like to thereby use the stored information of engine rotation stop position as information of an initial position of the crankshaft 24 at a succeeding engine starting to start fuel injection control and ignition control.

An engine rotation stop control in the first embodiment is described with reference to time charts (an example of a four-cylinder engine) in FIGS. 2 and 3.

Figure 2:
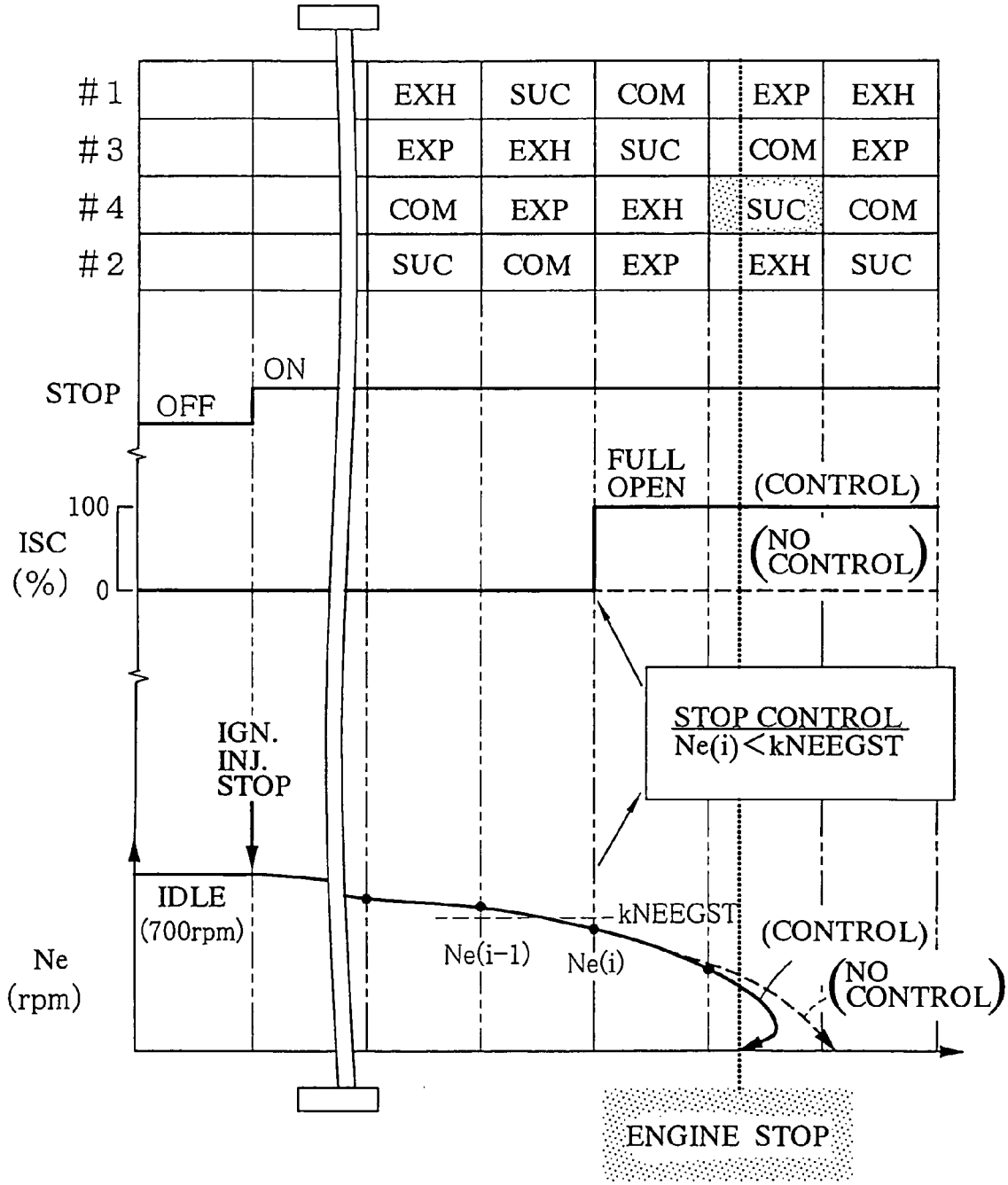
FIG. 2 is a time chart illustrating an example of engine rotation stop control.

As shown in FIG. 2, in the case where an engine stop command (ON) is generated by a demand for ignition switch turn-off operation or idling stop and both or either of ignition pulse and fuel injection pulse is stopped, the engine 11 continues to rotate due to inertia energy for some time thereafter while engine rotation decreases due to various losses (pumping loss, friction loss, driving loss for auxiliary devices, and so on). At this time, an intake air quantity is increased in the suction stroke (SUC) just before stop of the engine to increase compression pressure in a succeeding compression stroke (COM), whereby engine rotation is forcedly stopped. The explosion stroke and exhaust stroke of the engine 11 is indicated as EXP and EXH in FIG. 2, respectively.

An example of the engine rotation stop control is described.

Whether engine rotation is just before stop is determined depending upon whether an engine rotational speed Ne(i) becomes close to a predetermined value kNEEGST (for example, 400 rpm), and the ISC valve 17 is set to be fully opened (Duty=100%) at a point of time just before engine rotation stop so that an intake air quantity of the engine 11 is increased to increase compression pressure in a succeeding compression stroke. In an example of control shown in FIGS. 2 and 3, by increasing an intake air quantity in the suction stroke of a #3 cylinder, compression pressure of the #3 cylinder, in which an intake air quantity has been increased, is increased to increase forces for obstructing engine rotation, thereby forcedly stopping engine rotation.

Figure 3:
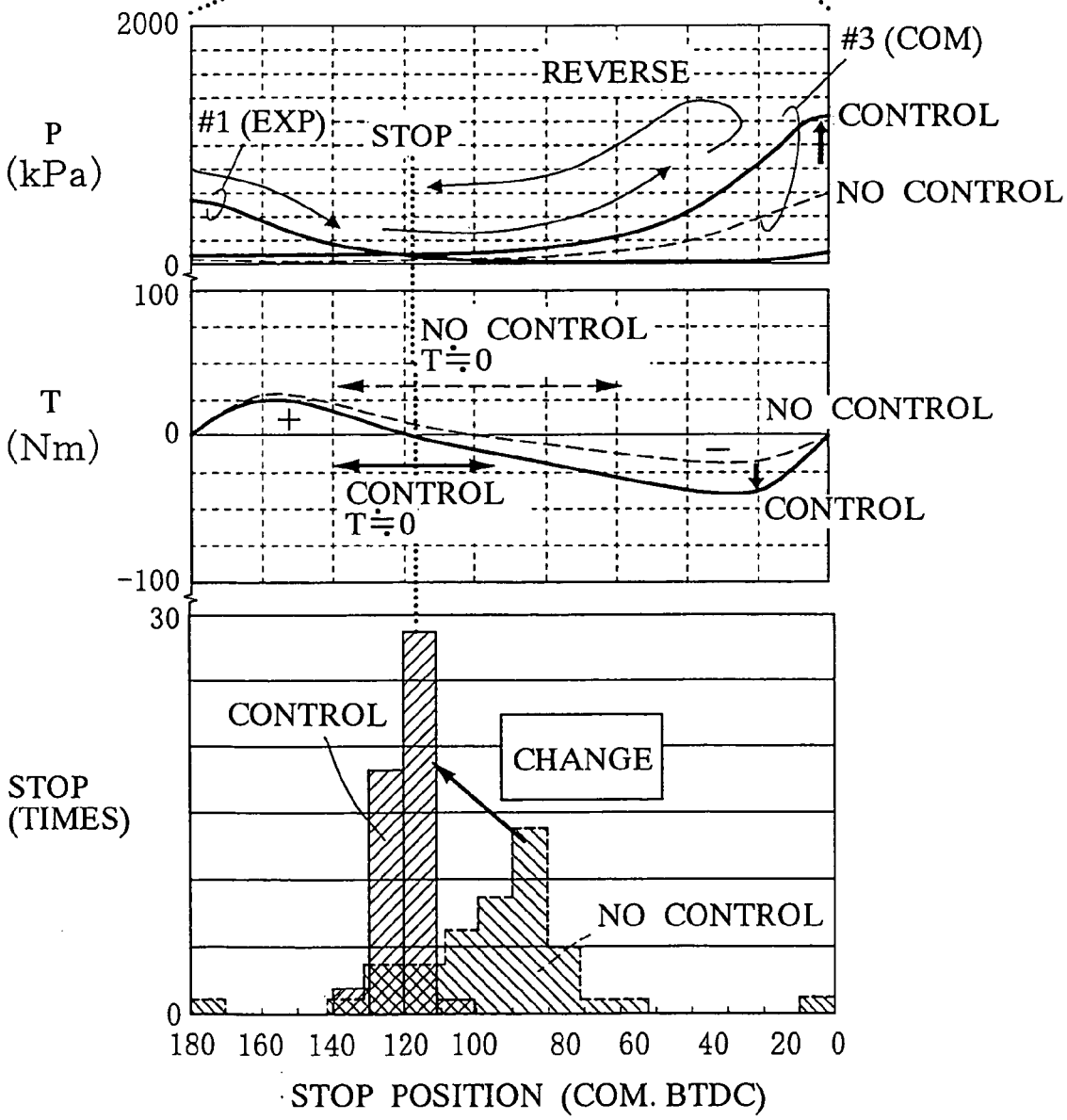
FIG. 3 is a time chart illustrating an example of engine rotation stop control.

FIG. 3 shows variation in a position of engine rotation stop in the case where the engine rotation stop control according to the embodiment is carried out and in the case where the engine rotation stop control is not carried out.

In the case where the engine rotation stop control is carried out, compression pressure P in that cylinder (the #3 cylinder in the example shown in FIG. 3), in which an intake air quantity has been increased in the suction stroke just before engine rotation stop, is increased. As the compression pressure P increases, a torque T in the negative direction is increased in the compression stroke to serve as forces for obstructing engine rotation, so that engine rotation is braked, that crank angle range (a crank angle range affording engine rotation stop), in which torque becomes equal to or less than engine friction, is narrowed than a conventional one, and engine rotation is stopped in such crank angle range. In the example of control shown in FIG. 3, engine rotation is stopped in a range of compression BTDC 140° CA to 100° CA of the #3 cylinder.

In contrast, in the case where the engine rotation stop control is not carried out, a torque T in the negative direction is not increased in the compression stroke and becomes balanced with a torque T in the positive direction in the expansion stroke of another cylinder (an expansion cylinder being a #1 cylinder in the example shown in FIG. 3), so that the negative torque does not act as forces for obstructing rotation in the stroke and an engine rotation stop position varies in a wide range since a range of crank angle, in which engine rotation is not stopped and torque falls below engine friction even when engine rotation is stopped. In the example of control shown in FIG. 3, an engine rotation stop position in the case where the engine rotation stop control is not carried out varies in a wide range in the vicinity of compression BTDC 140° CA to 60° CA, compression BTDC 180° CA, and compression TDC of the #3 cylinder. Therefore, it is not possible to accurately determine a cylinder for initial injection (initial injection cylinder) and a cylinder for initial ignition (initial ignition cylinder) at the time of next engine start.

The engine rotation stop control described above is carried out by the ECU 30 in the following manner in accordance with an engine rotation stop control program (routine) shown in FIG. 4. The program is repeatedly executed every predetermined time (for example, every 8 ms). When the program is started, it is first determined at step 101 whether engine rotation is stopped. At this time, whether engine rotation is stopped is determined depending upon, for example, whether a crank angle signal CRS from the crank angle sensor 26 is not input into the ECU 30 for a predetermined period of time (for example, 300 ms) or more.

When engine rotation is stopped, "YES" is determined at step 101 and the program is terminated without performing succeeding processing. In contrast, in the case where engine rotation is not stopped, "NO" is determined at step 101 and processing succeeding step 102 are carried out in the following manner.

First, it is determined at step 102 to step 105 whether conditions for executing the engine rotation stop control are met. The conditions for executing the engine rotation stop control include the following (1) to (4).

(1) For example, an engine stop command is generated by a demand for idling stop or an OFF operation of the ignition switch (step 102).

(2) Both fuel injection and ignition are stopped, and conditions for reduction in engine rotation and stop of engine rotation are met (step 103).

(3) An idling switch is in ON state, in which the throttle valve 14 is fully closed and the throttle opening degree TA is not more than a predetermined value (for example, 1.5 deg or less) (step 104).

(4) Engine rotational speed Ne(i) calculated every TDC (top dead center point) is less than a predetermined value kNEEGST (for example, 400 ms) (step 105).

When all the conditions (1) to (4) are met, the conditions for executing the engine rotation stop control are met. When any one of the former conditions is not met, the conditions for executing out the engine rotation stop control are not met.

In the case where the conditions for executing the engine rotation stop control are not met, that is, "NO" is determined in any one of step 102 to step 105, the processing proceeds to step 110 to set a control value of the ISC valve 17 to a target value DISC normally calculated in idling speed control, and then proceeds to step 111 to keep (or reset) an engine rotation stop control execution flag XEGSTCNT at "0" to terminate the program.

In the case where the engine rotation stop control execution conditions are met, that is, in the case where all of them are determined at step 102 to step 105 to be "YES", the processing proceeds to step 106 to determine whether an engine rotational speed Ne(i−1) at the last time is over a rotational speed kNEEGST just before stop (for example, 400 rpm). In the case where "NO" is determined at step 106, that is, in the case where an engine rotational speed Ne(i−1) at the last time is below the rotational speed kNEEGST just before stop, the program is terminated.

In contrast, in the case where "YES" is determined at step 106, that is, in the case where an engine rotational speed Ne(i−1) at the last time is over the rotational speed kNEEGST just before stop and an engine rotational speed Ne(i) this time is below the rotational speed kNEEGST just before stop, engine rotation is determined to be just before stop and the processing proceeds to step 107 to forcedly set a control value of the ISC valve 17 to full opening (ISC valve Duty=100%) to increase an intake air quantity of the engine 11, thereby increasing a compression pressure in a succeeding compression stroke to forcedly stop engine rotation. The processing at step 107 serves as stop-time compression pressure increase control means.

Then the engine rotation stop control execution flag XEGSTCNT is set in a succeeding step 108 to "1", which means that the engine rotation stop control execution is over. Thereafter, the processing proceeds to step 109 to store information of an engine rotation stop position (for example, information of a cylinder CEGSTIN stopped in the suction stroke SUC and a cylinder CEGSTCMP stopped in the compression stroke COM) in the backup RAM 32. In this case, in the examples of control shown in FIGS. 2 and 3, a #4 cylinder is stored as a suction stroke cylinder CEGSTIN at the time of engine rotation stop, and a #3 cylinder is stored as a compression-stroke cylinder CEGSTCMP.

In the engine rotation stop control according to the embodiment, the ISC valve 17 is used as means for increasing a compression pressure in the compression stroke, and a compression pressure in a succeeding compression stroke is increased by forcedly opening the ISC valve 17 fully just before engine rotation stop to increase an intake air quantity of the engine 11. In the case where the present invention is applied to a system mounting thereon an electronic throttle for electrically controlling a throttle opening by means of an actuator such as motor or the like, a compression pressure in a succeeding compression stroke may be increased by forcedly opening a throttle valve just before engine rotation stop to increase an intake air quantity.

In addition, it is general in control during normal operation to take account of response delay until an air is supplied to a combustion chamber after opening of the ISC valve 17. In the embodiment, however, since a throttle valve or the ISC valve 17 is controlled just before engine rotation stop, it is possible to increase an intake air quantity without taking account of response delay of an air, thus enabling accurately increasing a compression pressure at the time of stop.

In addition, a compression pressure may be increased by adopting a variable valve timing control mechanism as means for increasing a compression pressure at the time of engine rotation stop to spark-advance control an intake valve timing just before engine rotation stop to close an intake valve at an intake BDC (bottom dead center point) to thereby prevent an air in a cylinder from counter-flowing toward the intake pipe 13 early in the compression stroke.

Figure 10:
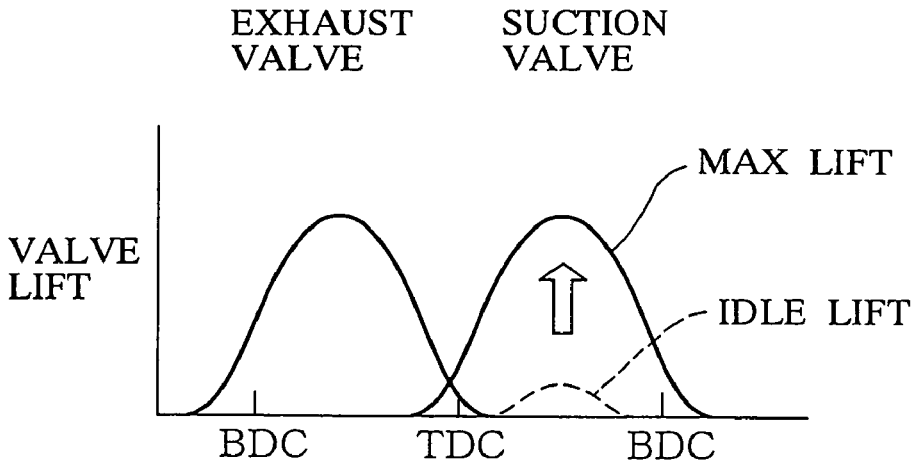
FIG. 10 is a diagram illustrating an example of control, in which a variable valve lift control mechanism is used to perform engine rotation stop control.

Alternatively, a compression pressure may be increased by adopting a variable valve lift control mechanism as means for increasing a compression pressure at the time of engine rotation stop to increase an intake valve lift just before engine rotation stop as shown in FIG. 10 to thereby increase an intake air quantity.

Figure 4:
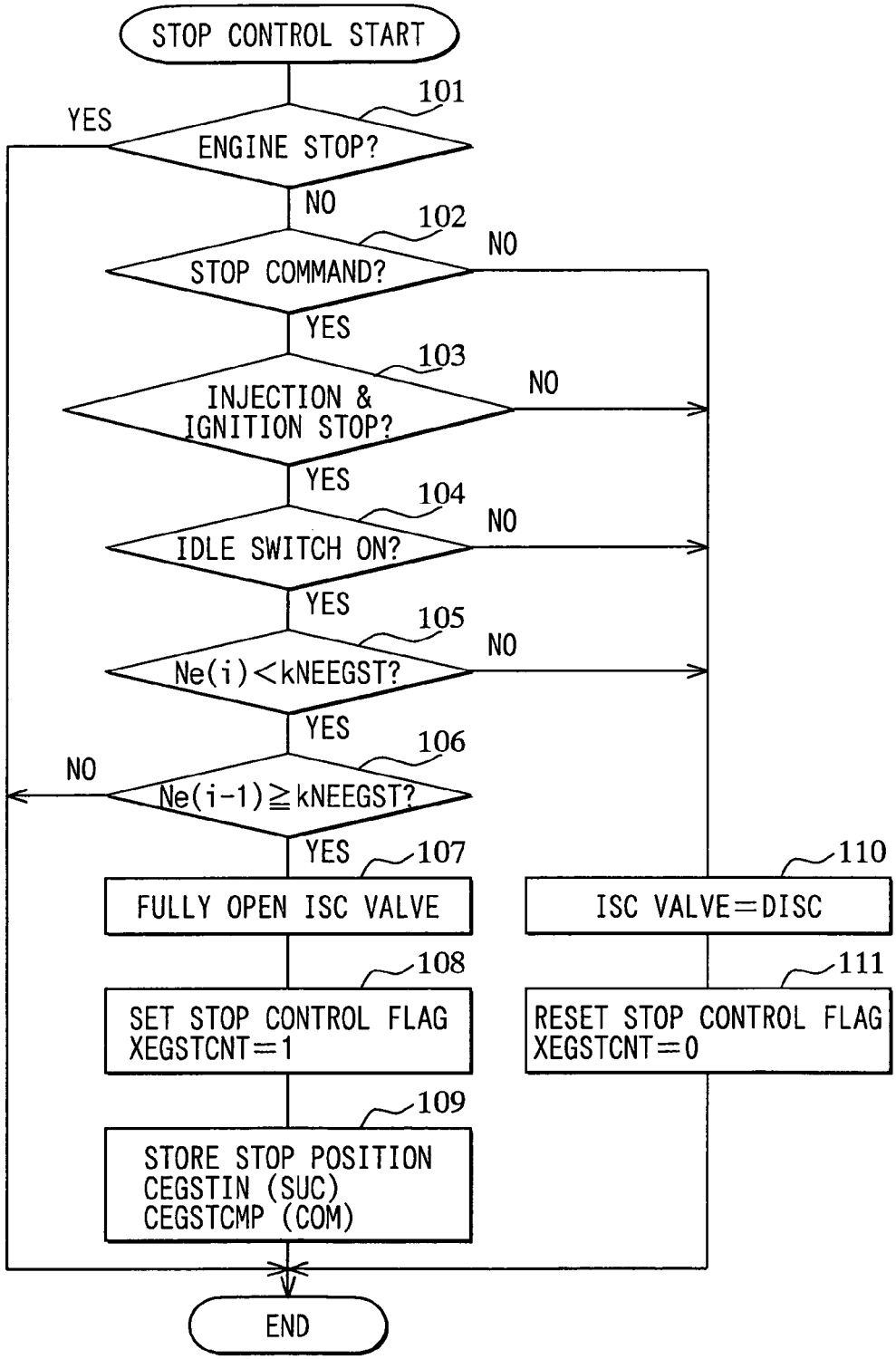
FIG. 4 is a flow chart illustrating processing in an engine rotation stop control program.
Figure 6:
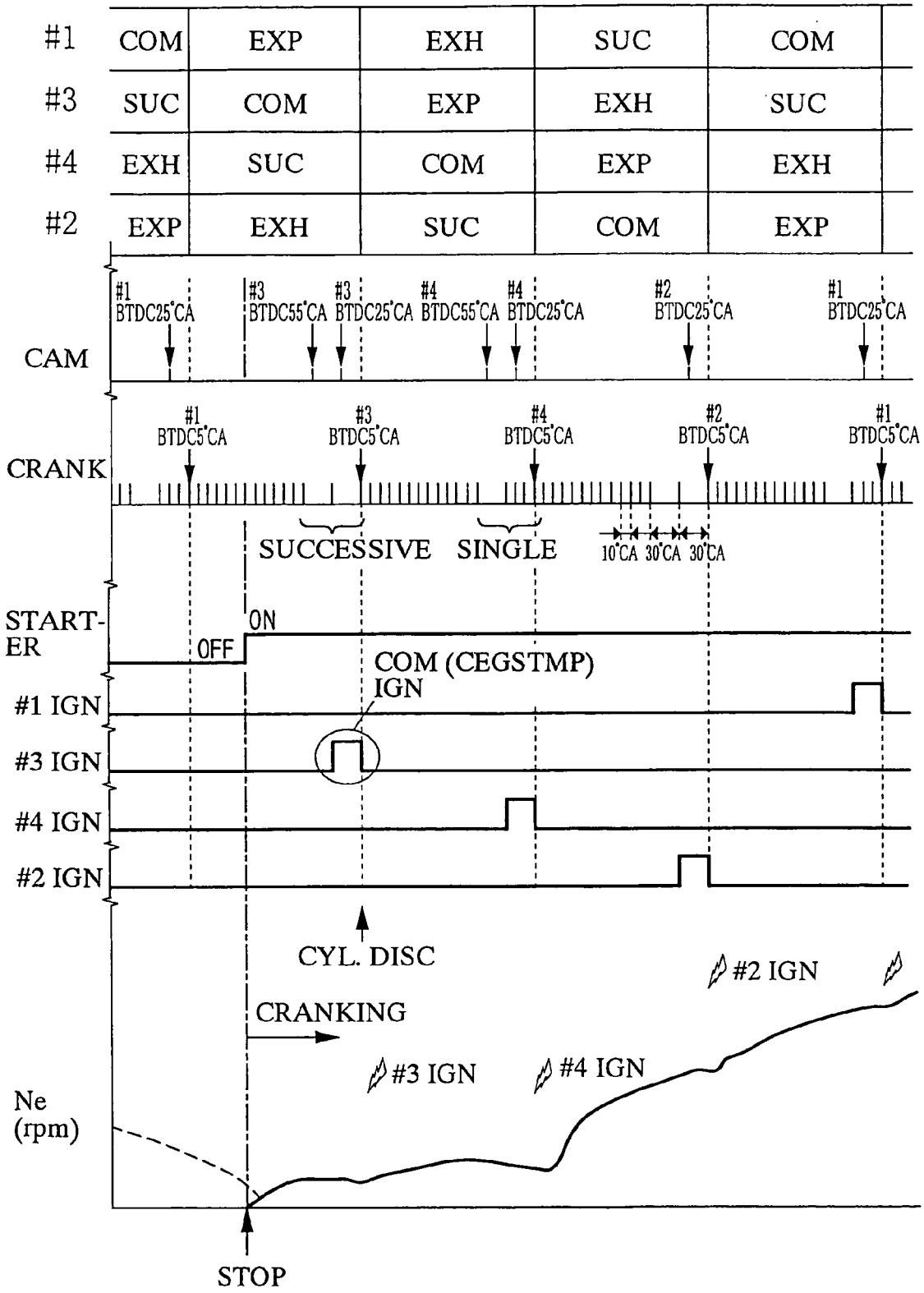
FIG. 6 is a time chart illustrating an example of ignition control at the engine start.

Subsequently, methods for fuel injection control and ignition control at the start of an engine, executed by means of information of an engine rotation stop position (information of the suction stroke cylinder CEGSTIN and the compression-stroke cylinder CEGSTCMP at the time of engine rotation stop) stored in the backup RAM 32 at step 109 of the engine rotation stop control program shown in FIG. 4 are described making use of time charts (an example of a four-cylinder engine) shown in FIGS. 5 and 6. In FIGS. 5 and 6, cam angle signals are output from the cam angle sensor 29 such that 6-pulse signals are output every two revolutions of the crankshaft (720° CA). Crank angle signals are output from the crank angle sensor 26 such that signals having the number of pulses amounting to 36 pulses minus 6 pulses are output every revolution of the crankshaft 24 (360° CA).

In addition, crank angle signals have a pulse interval whenever a pulse is input, and detect presence and absence of missing on the basis of such pulse interval. Then cylinder discrimination is performed in a manner described later on the basis of the number of pulses of cam angle signals and results of detection of missing of crank angle signals.

In the fuel injection control at the start on the basis of information of stop position shown in FIG. 5, since information of stop position has been previously stored, fuel injection control is executed on the basis of the information of stop position. More specifically, when a starter is activated to begin engine cranking, fuel injection (INJ) is performed in a suction stroke cylinder CEGSTIN (a #4 cylinder in the example shown in FIG. 5) stored at that time (a starter asynchronous injection in FIG. 5).

Thereafter, cylinder discrimination is performed on the basis of the number of pulses of cam angle signals and missing of crank angle signals, on the basis of detection results of which cylinder discrimination synchronous injection control is performed to inject fuel in synchronism with the suction strokes of respective cylinders.

In the ignition control at the start on the basis of information of stop position shown in FIG. 6, since information of stop position has been previously stored, ignition control is executed on the basis of the information of stop position. Specifically, when a starter is activated to begin engine cranking and missing of crank angle signals is detected (BTDC 35° CA), ignition energizing of a compression-stroke cylinder CEGSTCMP (a #3 cylinder in the example shown in FIG. 6) stored at that time is started, and thereafter ignition (IGN) is carried out at a timing of BTDC 5° CA (the latter half missing of continuous lack in the compression stroke of the #3 cylinder).

After ignition, cylinder discrimination is performed on the basis of the number of pulses of cam angle signals and missing of crank angle signals, and ignition control is performed on the basis of detection results of the cylinder discrimination.

Figure 7:
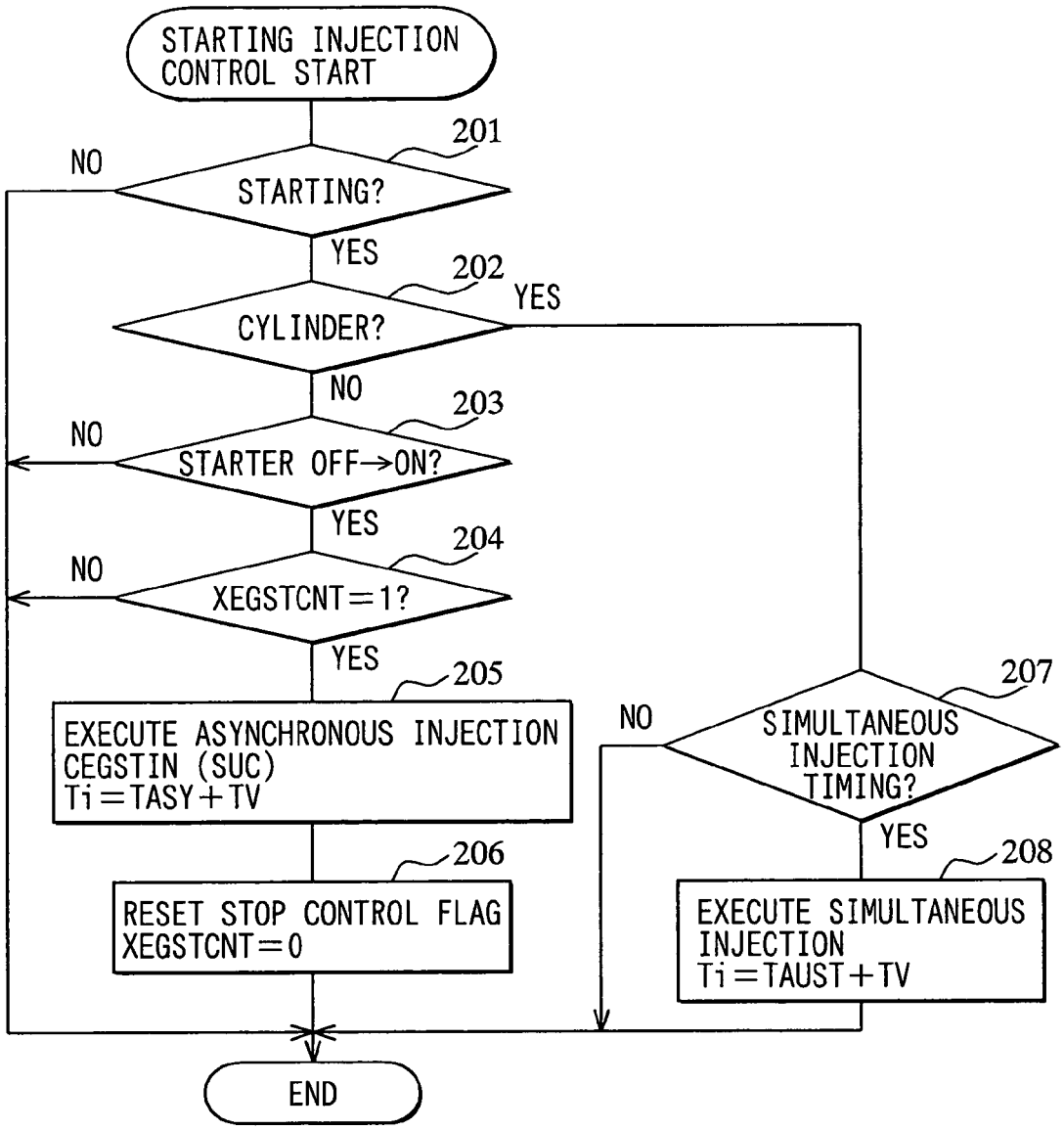
FIG. 7 is a flow chart illustrating processing in a fuel injection control program at the engine start.
Figure 8:
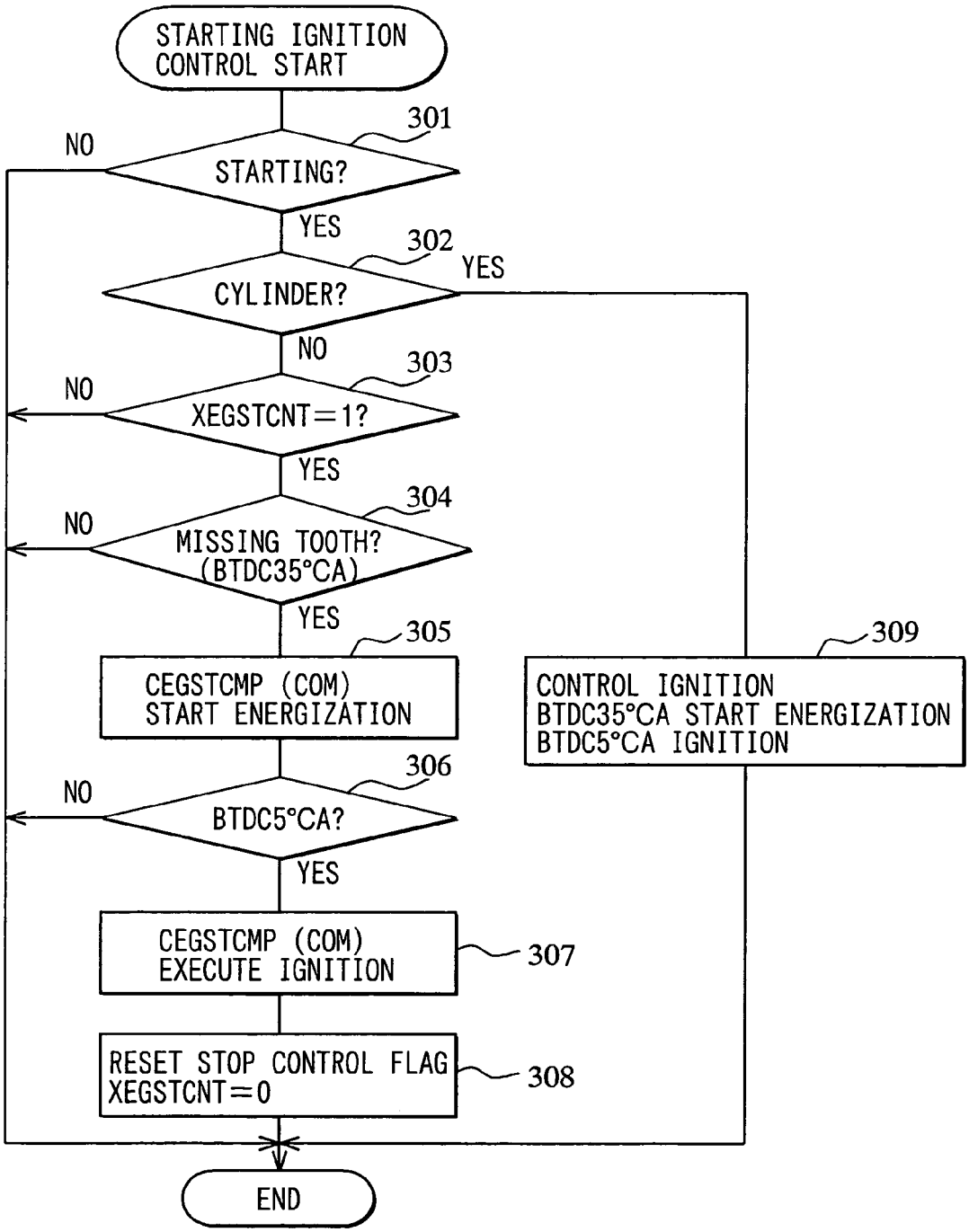
FIG. 8 is a flowchart illustrating processing in an ignition control program at the engine start.
Figure 9:
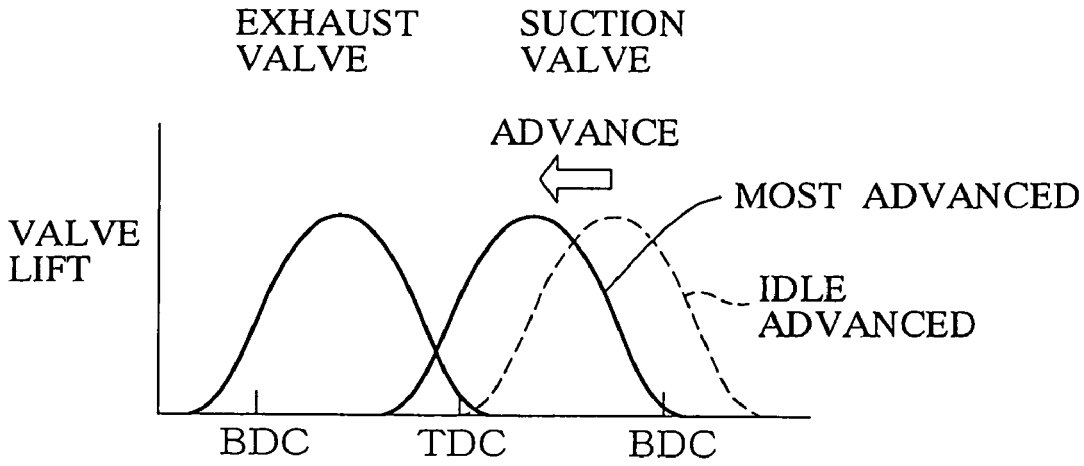
FIG. 9 is a diagram illustrating an example of control, in which a variable valve timing control mechanism is used to perform engine rotation stop control.

The above fuel injection control and ignition control at the start are performed by the ECU 30 in accordance with programs shown in FIGS. 7 and 8.

The fuel injection control program, shown in FIG. 7, at the start is repeatedly executed every predetermined time (for example, every 4 ms). When the program is started, it is first determined at step 201 whether starting is one when an engine rotational speed is below a predetermined value (for example, 500 rpm). In the case where an engine rotational speed is determined to be over the predetermined value (for example, 500 rpm), the program is terminated without performing the following processing.

In contrast, in the case where it is determined at step 201 whether starting is one when an engine rotational speed is below a predetermined value (for example, 500 rpm), fuel injection control at the start is performed as follows in processing subsequent to step 202. First, it is first determined at step 202 whether cylinder discrimination on the basis of the number of pulses of cam angle signals and missing of crank angle signals has been completed. In the case where cylinder discrimination has been completed, the processing proceeds to step 207 to determine whether a present crank angle is at a synchronous injection timing, since the present crank angle (present position of the crankshaft 24) is known by the cylinder discrimination. As a result, when it is determined that the present crank angle is not at a synchronous injection timing, the program is terminated without performing anything.

When it is determined at step 207 that the present crank angle is at a synchronous injection timing, the processing proceeds to step 208 to calculate a synchronous injection quantity Ti according to the following formula to carry out synchronous injection.

$$Ti=TAUST+TV$$

Here, TAUST indicates an effective injection time determined according to respective parameters of the engine 11, and is specifically calculated by means of a data map or the like according to cooling water temperature, intake pipe pressure, engine rotational speed, and so on. Also, TV indicates an ineffective injection time required for the fuel injection valves 19 to respond, and is calculated by means of a data map or the like according to battery voltage.

Meanwhile, when it is determined at step 202 that cylinder discrimination has not been completed, it is determined in the succeeding step 203 and step 204 whether fuel injection control execution conditions based on a stop position storage are met. The execution conditions include, for example, the following two conditions (1) and (2).

(1) A starter is switched to ON from OFF and cranking at the start is begun (step 203).

(2) An engine rotation stop control execution flag XEGSTCNT is set to "1", which means that the engine rotation stop control execution is over (step 204).

When both conditions (1) and (2) are met, the fuel injection control execution conditions based on the stop position storage are met. When either of the conditions is not met, the fuel injection control execution conditions based on the stop position storage are not met.

In the case where the fuel injection control execution conditions based on the stop position storage are not met, that is, in the case where "NO" is determined at either of step 203 and step 204, the program is terminated without performing the following processing.

In contrast, in the case where the fuel injection control execution conditions based on the stop position storage are met, that is, in the case where "YES" is determined at both step 203 and step 204, the processing proceeds to step 205 to execute fuel injection control based on the stop position storage. The fuel injection control based on the stop position storage is performed in asynchronism with an actual crank angle. More specifically, asynchronous injection into a suction stroke cylinder CEGSTIN is carried out on the basis of the stop position storage at a timing (substantially, a timing, at which it is determined at step 203 that a starter is switched to ON from OFF), at which "YES" is determined in both step 203 and step 204. At this time, an asynchronous injection quantity Ti is calculated according to the following formula.

$$Ti=TASYST+TV$$

Here, TASYST indicates an effective injection time determined according to respective parameters of the engine, and is specifically calculated by means of a map or the like according to cooling water temperature, intake pipe pressure, and so on. Also, TV indicates an ineffective injection time required for the fuel injection valves 19 to respond, and is calculated by means of a map or the like according to battery voltage and so on.

After asynchronous injection is carried out, the processing proceeds to step 206 to reset an engine rotation stop control execution flag XEGSTCNT to "0", and the program is terminated.

In the example of the above control, asynchronous injection into a suction stroke cylinder CEGSTIN is carried out at a timing, at which a starter is switched to ON from OFF. In the case where injection can be carried out in the same suction stroke, however, fuel injection may be carried out when crank angle signals are input predetermined times, and fuel injection may be carried out after the lapse of a predetermined period of time after a starter is switched to ON from OFF and a crank angle signal is input.

Start-time ignition control shown in FIG. 8 is repeatedly executed every predetermined period of time (for example, whenever a crank angle signal is input). When the program is started, it is first determined at step 301 whether starting is one when an engine rotational speed is below a predetermined value (for example, 500 rpm). In the case where an engine rotational speed is determined to be over a predetermined value (for example, 500 rpm), the program is terminated without performing the following processing.

In contrast, in the case where it is determined at step 301 that starting is one when an engine rotational speed is below a predetermined value (for example, 500 rpm), start-time ignition control is performed in the following manner according to processing succeeding step 302. First, it is determined at step 302 whether cylinder discrimination on the basis of the number of pulses of cam angle signals and missing of crank angle signals has been completed. In the case where cylinder discrimination has been completed, the processing proceeds to step 309 to begin energizing in respective cylinders at BTDC 35° CA to carry out ignition at BTDC 5° CA, since a present crank angle (a present position of the crankshaft 24) is known by the cylinder discrimination.

When it is determined at step 302 that cylinder discrimination has not been completed, it is determined in the succeeding step 303 and step 304 whether ignition control execution conditions based on the stop position storage are met. The execution conditions include, for example, the following two conditions (1) and (2).

(1) An engine rotation stop control execution flag XEGSTCNT is set to "1", which means that the engine rotation stop control execution is over (step 303).

(2) Missing of crank angle signals (BTDC 35° CA) is detected (step 304).

When both conditions (1) and (2) are met, the ignition control execution conditions based on the stop position storage are met. When either of both conditions is not met, the ignition control execution conditions based on the stop position storage are not met.

In the case where the ignition control execution conditions based on the stop position storage are not met, that is, in the case where "NO" is determined in either of step 303 and step 304, the program is terminated without performing the following processing.

In contrast, in the case where the ignition control execution conditions based on the stop position storage are met, that is, in the case where "YES" is determined in both step 303 and step 304, ignition energizing control based on the stop position storage is performed in the following manner according to processing subsequent to step 305. When missing of crank angle signals (BTDC 35° CA) is detected, the processing proceeds to step 305 to begin energizing of a compression-stroke cylinder CEGSTCMP based on the stop position storage. Then, the processing proceeds to step 306 to determine on the basis of the stop position storage whether ignition is at a timing of BTDC 5° CA. In this case, since a cylinder or cylinders stopping in the compression stroke are previously stored, it is possible to discriminate between single missing and continuous missing and to determine a timing of BTDC 5° CA.

In the case where it is determined at step 306 that ignition is not at a timing of BTDC 5° CA, the program is terminated. In the case where it is determined that ignition is at a timing of BTDC 5° CA, the processing proceeds to step 307 to carry out ignition of a compression-stroke cylinder CEGSTCMP based on the stop position storage at a timing of BTDC 5° CA. Thereafter, the processing proceeds to step 308 to set an engine rotation stop control execution flag XEGSTCNT to "0", and the program is terminated.

In the embodiment described above, since an intake air quantity is increased by the engine rotation stop control just before engine rotation stop to increase a compression pressure in the compression stroke, engine rotation can be forcedly stopped by increasing a negative torque due to an increase in compression pressure just before engine rotation stop. Owing to an increase in compression pressure with such engine rotation stop control, a crank angle range (a crank angle range affording engine rotation stop), in which torque becomes equal to or less than engine friction, is narrowed than a conventional one. As a result, variation in engine rotation stop position can be included within a smaller crank angle range than a conventional one and information of an engine rotation stop position (information of the suction stroke cylinder CEGSTIN and the compression-stroke cylinder CEGSTCMP at the time of engine rotation stop) can be accurately found to be stored in the backup RAM 32. Thereby, an engine can be started by making use of information of engine rotation stop position stored in the backup RAM 32 at the time of engine start to accurately determine an initial injection cylinder and an initial ignition cylinder even before completion of cylinder discrimination, whereby it is possible to improve a starting quality and exhaust emission at the start.

In addition, the present invention is not limited to four-cylinder engines but can be applied to three- or less-cylinder engines, or five- or more-cylinder engines to be embodied. Further, the present invention is not limited to intake port injection engines shown in FIG. 1 but can be applied also to in-cylinder injection engines and lean-burn engines to be embodied.

(Second Embodiment)

Figure 11:
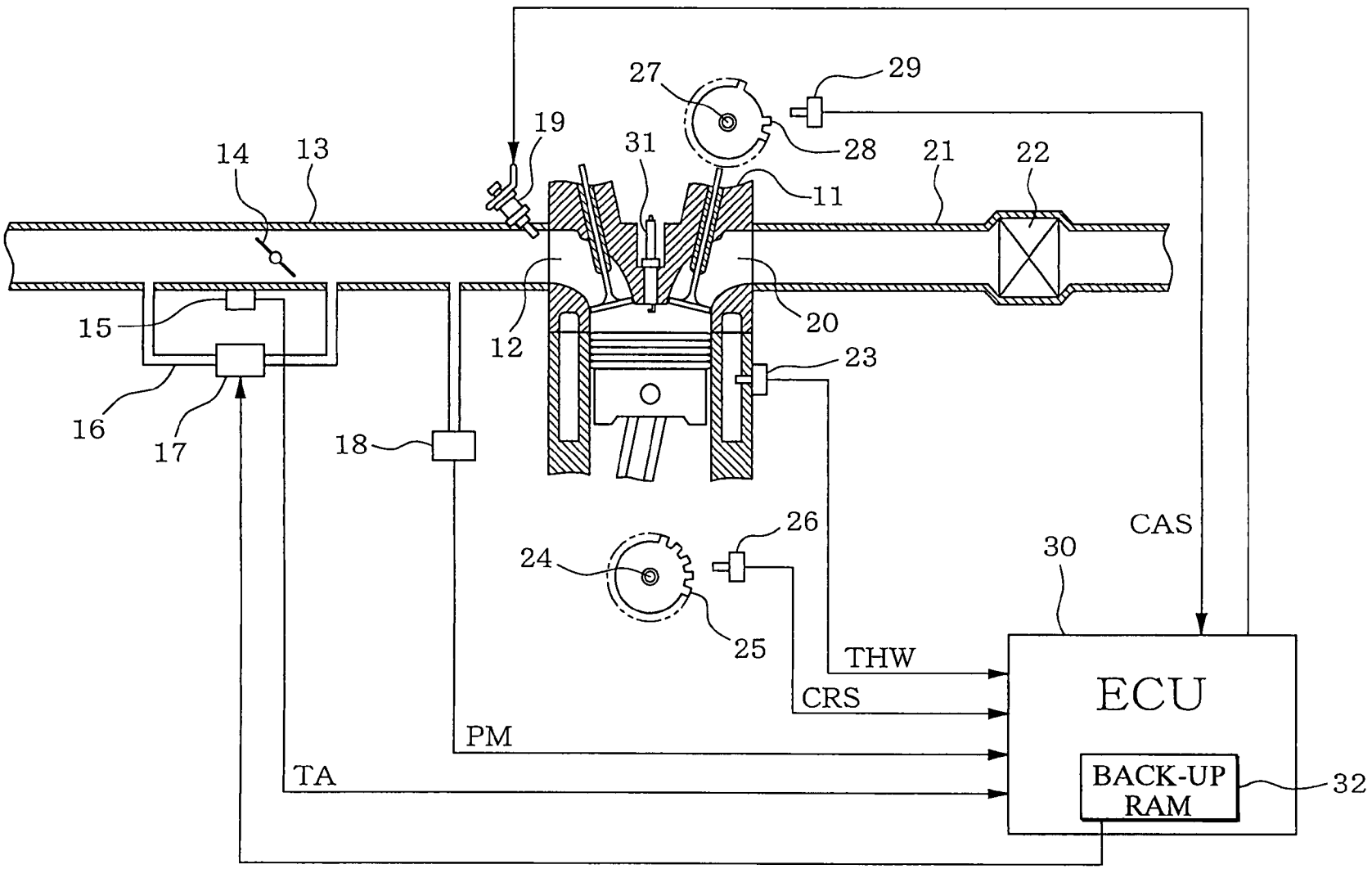
FIG. 11 is a schematic diagram showing an engine control system in a second embodiment of the present invention.
Figure 12:
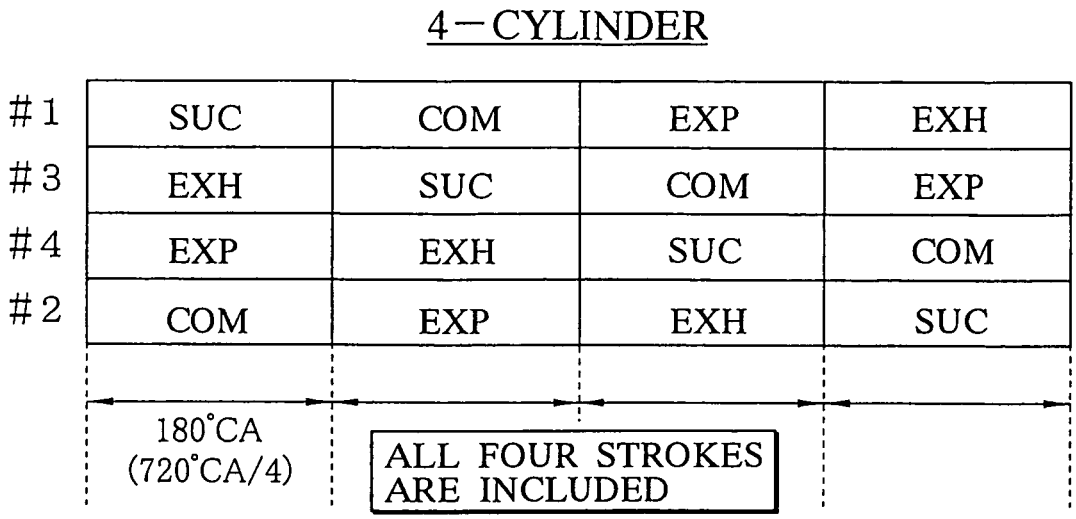
FIG. 12 is a diagram showing a state of strokes of respective cylinders of a four-cylinder engine.
Figure 13:
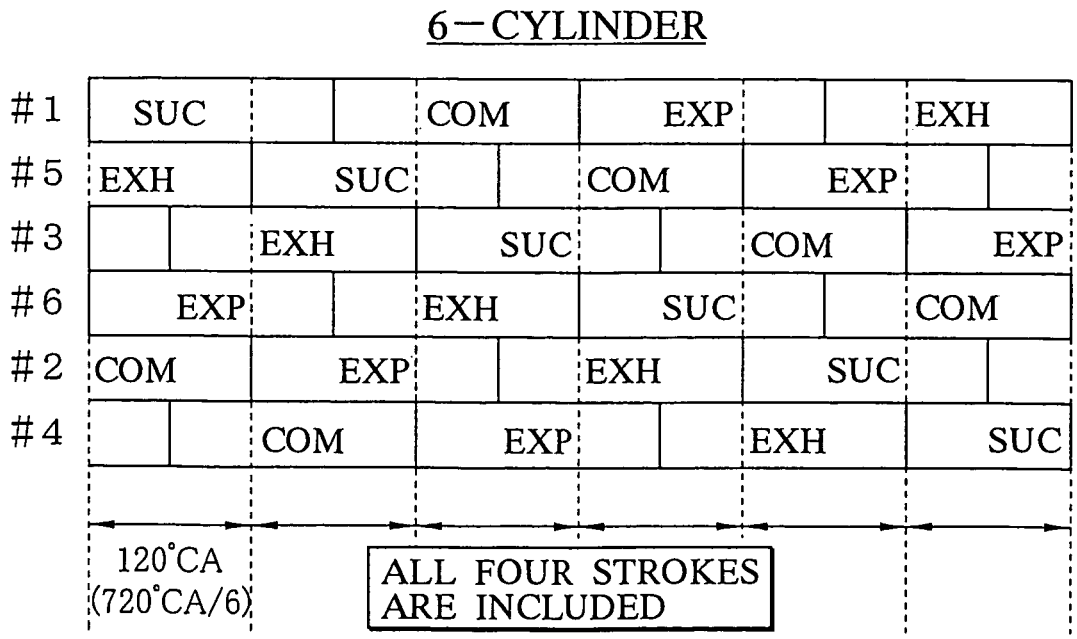
FIG. 13 is a diagram showing a state of strokes of respective cylinders of a six-cylinder engine.

A second embodiment of the present invention is also configured, as shown in FIG. 11, in the same manner as the first embodiment (FIG. 1).

Figure 14:
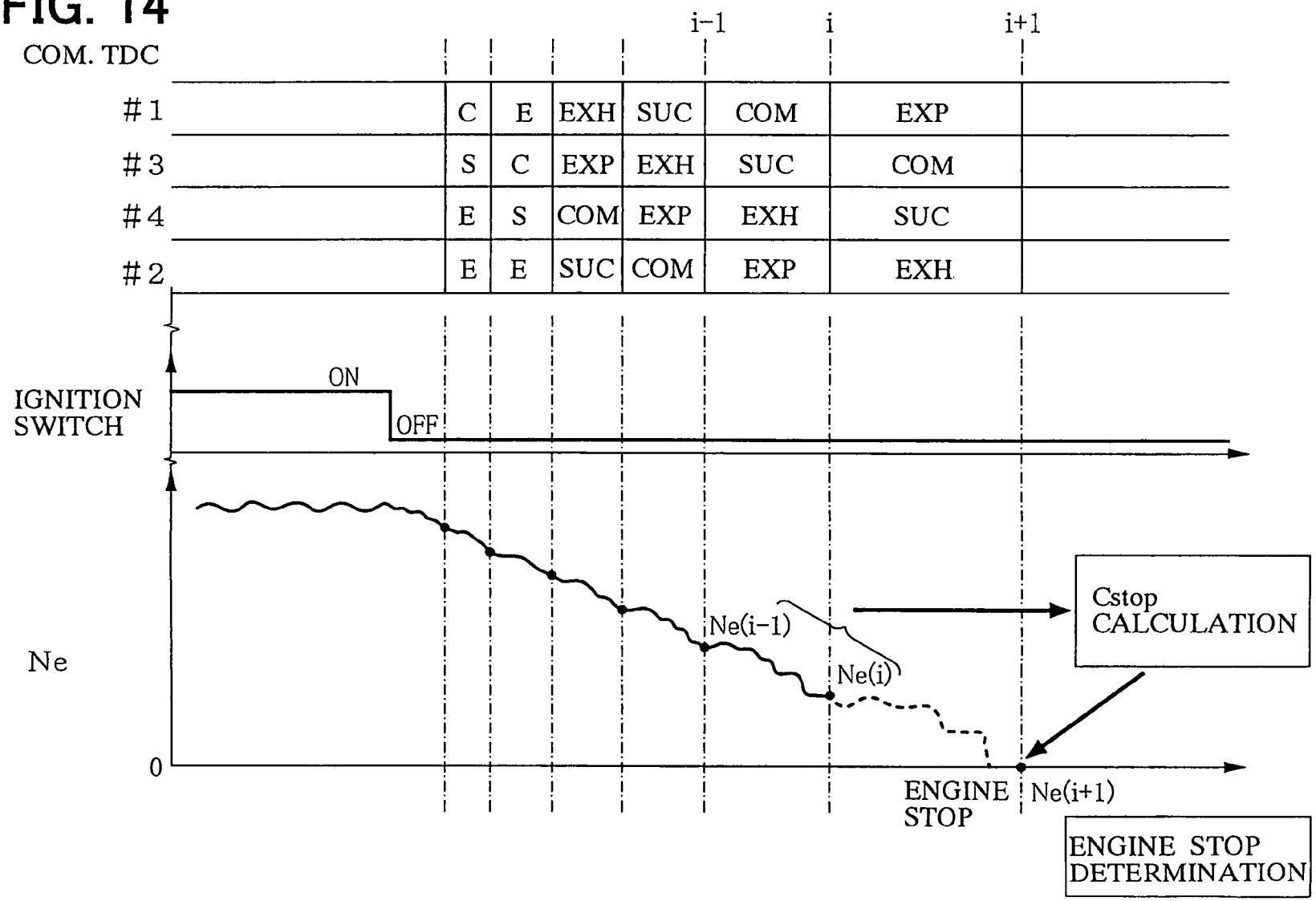
FIG. 14 is a time chart illustrating a method of estimating an engine rotation stop position according to the second embodiment.
Figure 15:
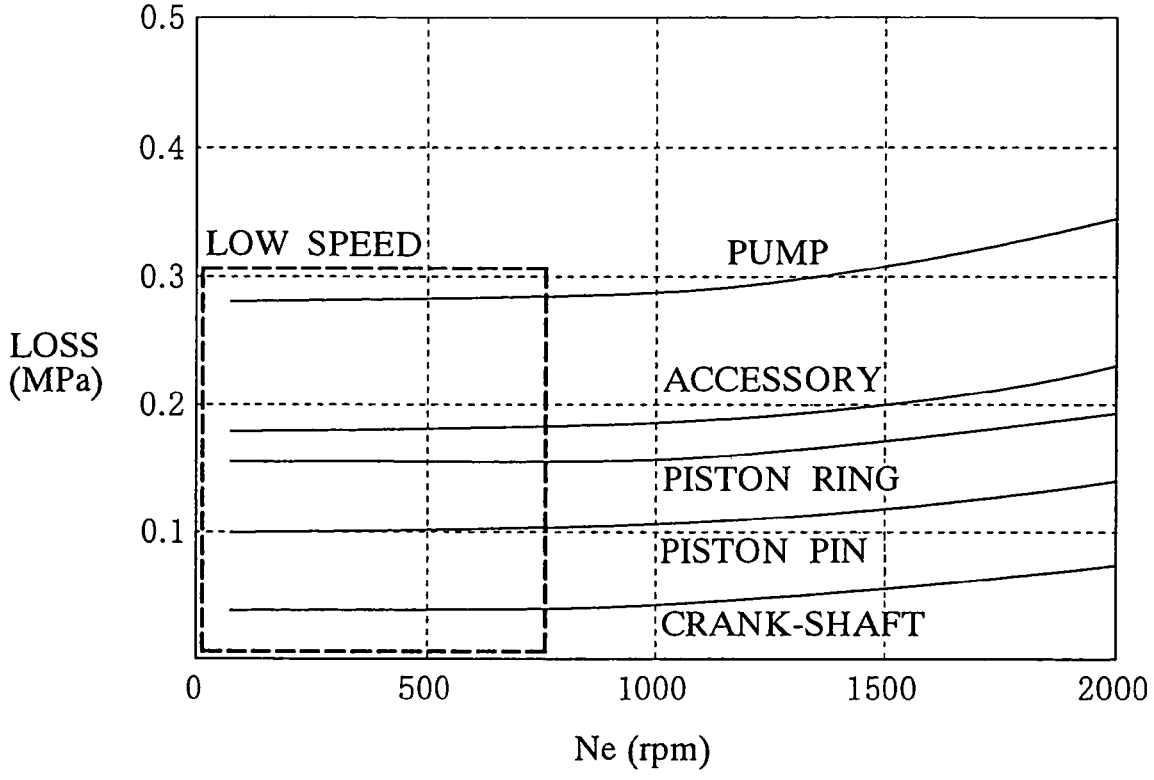
FIG. 15 is a diagram illustrating the relationship between an engine rotational speed and magnitudes of various losses in a gasoline engine.

According to the second embodiment, an engine rotation stop position is estimated as indicated in a time chart in the course of engine stop shown in FIG. 14. An instantaneous engine rotational speed Ne at respective compression TDCs is used as a parameter representative of engine operation. The ECU 30 measures a period of time required for rotation of the crankshaft 24 over, for example, 30° CA on the basis of output intervals of crank pulse signals CRS to calculate the instantaneous rotational speed Ne.

Here, energy balance at an i-th compression TDC (TDC (i)) in FIG. 14 is considered. Pumping loss, friction loss in respective parts, and driving loss in respective auxiliary devices are taken into account as work to obstruct engine operations. Assuming kinetic energy of an engine at a point of time TDC(i−1) to be as E(i−1), the kinetic energy E(i−1) is taken by work caused by the respective losses until a subsequent TDC (i) is attained, so that it is decreased to E(i). The relationship of such energy balance is represented by the following formula (1).

$$E(i)=E(i-1)-W \quad (1)$$

Here, W indicates an addition of all work taken by the respective losses in an interval between TDC(i−1) and TDC(i).

Also, supposing engine operations to be rotational motions, the motions can be represented by the following formula (2).

$$E=J\times 2\pi^2\times Ne^2 \quad (2)$$

Here, E indicates kinetic energy of an engine, J indicates moment of inertia determined for each engine, and Ne indicates an instantaneous rotational speed.

By the use of the formula (2), the relationship of energy balance in the formula (1) can be replaced by the relationship of an instantaneous rotational speed change represented by the following formula (3).

$$Ne(i)^2=Ne(i-1)^2-W/(J\times 2\pi^2) \quad (3)$$

In the second embodiment, a second term in the right side of the formula (3) is a parameter Cstop for obstructing engine operations and defined as in the following formula (4).

$$Cstop=W/(J\times 2\pi^2) \quad (4)$$

The parameter Cstop for obstructing engine operations is calculated by the use of the following formula (5), which is deduced from the formula (3) and the formula (4).

$$Cstop=Ne(i-1)^2-Ne(i)^2 \quad (5)$$

Also, the parameter Cstop for obstructing engine operations is determined by that work load W, which obstructs respective losses between TDCs, and moment of inertia J, as defined by the formula (4). Under movement conditions of low revolution as in the course of engine stop, pumping loss, friction loss in respective parts and driving loss in respective auxiliary devices, which are taken into account as work for obstructing engine operations, assume substantially constant values irrespective of an engine rotational speed Ne. Accordingly, that work load W, which obstructs engine operations, assumes a substantially constant value between all TDCs in the course of engine stop. Additionally, since the moment of inertia J assumes values peculiar to respective engines, the parameter Cstop for obstructing engine operations assumes a substantially constant value in the course of engine stop.

Accordingly, using a present instantaneous rotational speed Ne(i) found in actual measurement and the parameter Cstop, calculated with the use of the formula (5), for obstructing motions between TDCs, a predicted value of an instantaneous rotational speed Ne(i+1) at TDC(i+1) being the first in the future can be calculated by the following formula (6a) or (6b).

$$\text{When } Ne(i)^2 \geqq Cstop,\ Ne(i+1)=\sqrt{Ne(i)^2-Cstop} \quad (6a)$$

$$\text{When } Ne(i)^2 < Cstop,\ Ne(i+1)=0 \quad (6b)$$

Here, in the case of $Ne(i)^2<Cstop$, that work load W, which obstructs motions between TDCs, becomes larger than kinetic energy E(i), which an engine has at present, so that Ne(i+1)=0 is assumed in order to avoid any imaginary number produced in results of calculation.

In the second embodiment, by making a comparison between a predicted value of an instantaneous rotational speed Ne(i+1) at TDC(i+1) being the first in the future and a preset stop determination value Nth, whether engine rotation is stopped is determined to estimate a state of strokes of respective cylinders in an engine rotation stop position.

Figure 16:
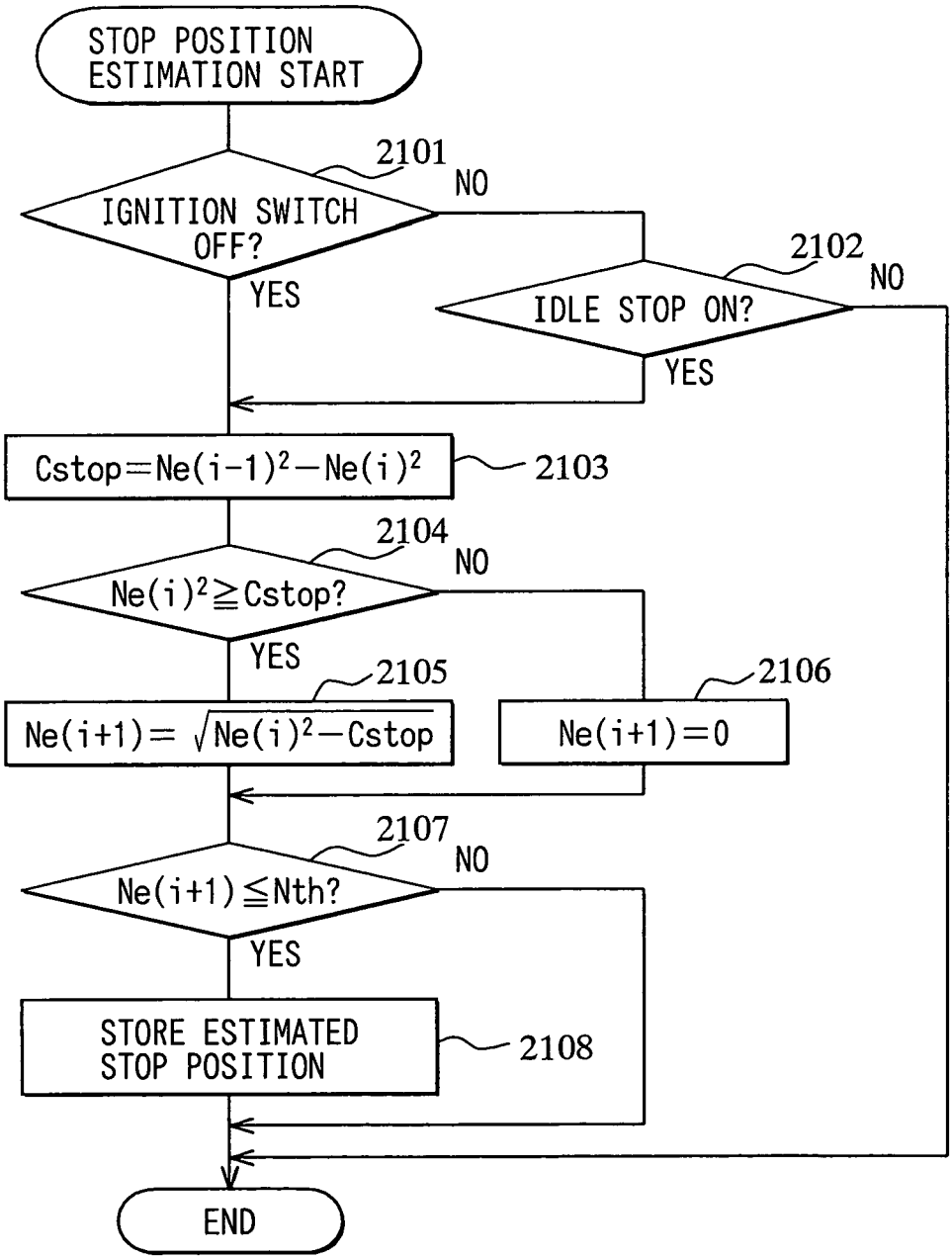
FIG. 16 is a flow chart illustrating processing in an engine rotation stop position estimation program according to the second embodiment.

The above estimation of engine rotation stop position in the second embodiment is executed by the ECU 30 in accordance with an engine rotation stop position estimation program shown in FIG. 16. The program is executed every TDC and serves as rotation stop position estimation means. When the program is started, whether an engine stop command is generated is determined depending upon whether "YES" is determined in either of step 2101 and step 2102. More specifically, either in the case where the ignition switch is determined at step 2101 to be OFF, or in the case where a demand for idling stop is determined at step 2102 to be ON, it is determined that a demand for engine stop has been generated, and processing subsequent to step 2103 are executed to estimate an engine rotation stop position.

Meanwhile, in the case where "NO" is determined in both step 2101 and step 2102, that is, in the case where the IG switch is ON and a demand for idling stop is OFF, it is determined that the engine continues combustion and is not in the course of stop, and the program is terminated without performing estimation of an engine rotation stop position.

As described above, when "YES" is determined in either of step 2101 and step 2102, it is determined that the engine is in the course of stop, and the processing proceeds to step 2103 to use an instantaneous rotational speed Ne(i−1) at TDC(i−1) at the last time and an instantaneous rotational speed Ne(i) at TDC (i) at present to calculate a parameter Cstop for obstructing engine operations, with the use of the formula (5). The processing at step 2103 serves as second parameter calculation means.

After the calculation of the parameter Cstop, a predicted value of an instantaneous rotational speed Ne(i+1) at TDC (i+1) being the first in the future is calculated in the following manner at step 2104 to step 2106. First, it is determined at step 2104 whether $Ne(i)^2 \geqq Cstop$ is established. When $Ne(i)^2 \geqq Cstop$, the processing proceeds to step 2105 to calculate a predicted value of an instantaneous rotational speed Ne(i+1) at TDC(i+1) being the first in the future with the use of the formula (6).

In contrast, when $Ne(i)^2<Cstop$, the processing proceeds to step 2106, in which a predicted value of an instantaneous rotational speed Ne(i+1) at TDC (i+1) being the first in the future is made 0.

After the calculation of the predicted value of an instantaneous rotational speed Ne(i+1), the processing proceeds to step 2107, in which by making a comparison between a predicted value of an instantaneous rotational speed Ne(i+1) at TDC(i+1) being the first in the future and a preset stop determination value Nth, it is determined whether engine rotation should pass TDC(i+1) to proceed to a subsequent process, or cannot pass TDC(i+1) to be stopped. That is, when the predicted value of an instantaneous rotational speed Ne(i+1) at TDC(i+1) being the first in the future exceeds the preset stop determination value Nth, it is determined that the engine passes TDC(i+1) being the first in the future to continue rotation, and the program is terminated.

In contrast, when the predicted value of an instantaneous rotational speed Ne(i+1) at TDC(i+1) being the first in the future falls below the preset stop determination value Nth, it is determined that kinetic energy, which an engine has at TDC(i) at present, is decreased by that work load W, which obstructs motions, and engine rotation cannot pass a subsequent TDC(i+1) to be stopped, and the processing proceeds to step 2108.

At step 2108, since it is estimated that the engine is stop between TDC(i) at present and a subsequent TDC(i+1), information of a state of strokes of respective cylinders (for example, a suction-stroke cylinders and compression-stroke cylinders) in the engine rotation stop position is stored as results of estimation of engine rotation stop position in the backup RAM 32, and the program is terminated.

Thereafter, when the engine is to be started up, that information of a state of strokes of respective cylinders in the engine rotation stop position, which has been stored in the backup RAM 32, is used as information of a state of strokes of respective cylinders at engine starting to determine an initial injection cylinder and an initial ignition cylinder, thus beginning fuel injection control and ignition control.

In the second embodiment described above, the formulae (6a) and (6b) for estimating an instantaneous rotational speed Ne(i+1) at a subsequent TDC(i+1) are deduced from that kinetic energy E, which an engine has, and a parameter Cstop for obstructing engine operations, and a predicted value of an instantaneous rotational speed Ne(i+1) at a subsequent TDC(i+1) is calculated by the use of the formulae (6a) and (6b) every TDC in the course of engine stop, so that it is possible to accurately estimate the change of engine rotational speed until engine rotation is stopped. Whether engine rotation is stopped is determined depending upon whether the predicted value of an instantaneous rotational speed Ne(i+1) at a subsequent TDC(i+1) falls below the preset stop determination value Nth, so that information of a state of strokes of respective cylinders in an engine rotation stop position can be estimated more accurately than in a conventional art.

Accordingly, by storing information of a state of strokes of respective cylinders in an engine rotation stop position, in the backup RAM 32, an initial injection cylinder and an initial ignition cylinder are accurately determined with the use of information of a state of strokes of respective cylinders in an engine rotation stop position as information of a state of strokes of respective cylinders at engine starting, thus enabling starting fuel injection control and ignition control and improving a starting quality and exhaust emission at the engine starting.

(Third Embodiment)

In the second embodiment, whether engine rotation is stopped is determined depending upon a predicted value of an instantaneous rotational speed at TDC being the first in the future, so that an engine rotation stop position is estimated just before engine rotation is stopped.

Hereupon, according to the third embodiment, the processing of estimating a further future instantaneous rotational speed is repeated by the use of a predicted value of a future instantaneous rotational speed and a parameter for obstructing motions, until it is determined that engine rotation is stopped, so that an engine rotation stop position can be estimated even not just before engine rotation is stopped.

Figure 17:
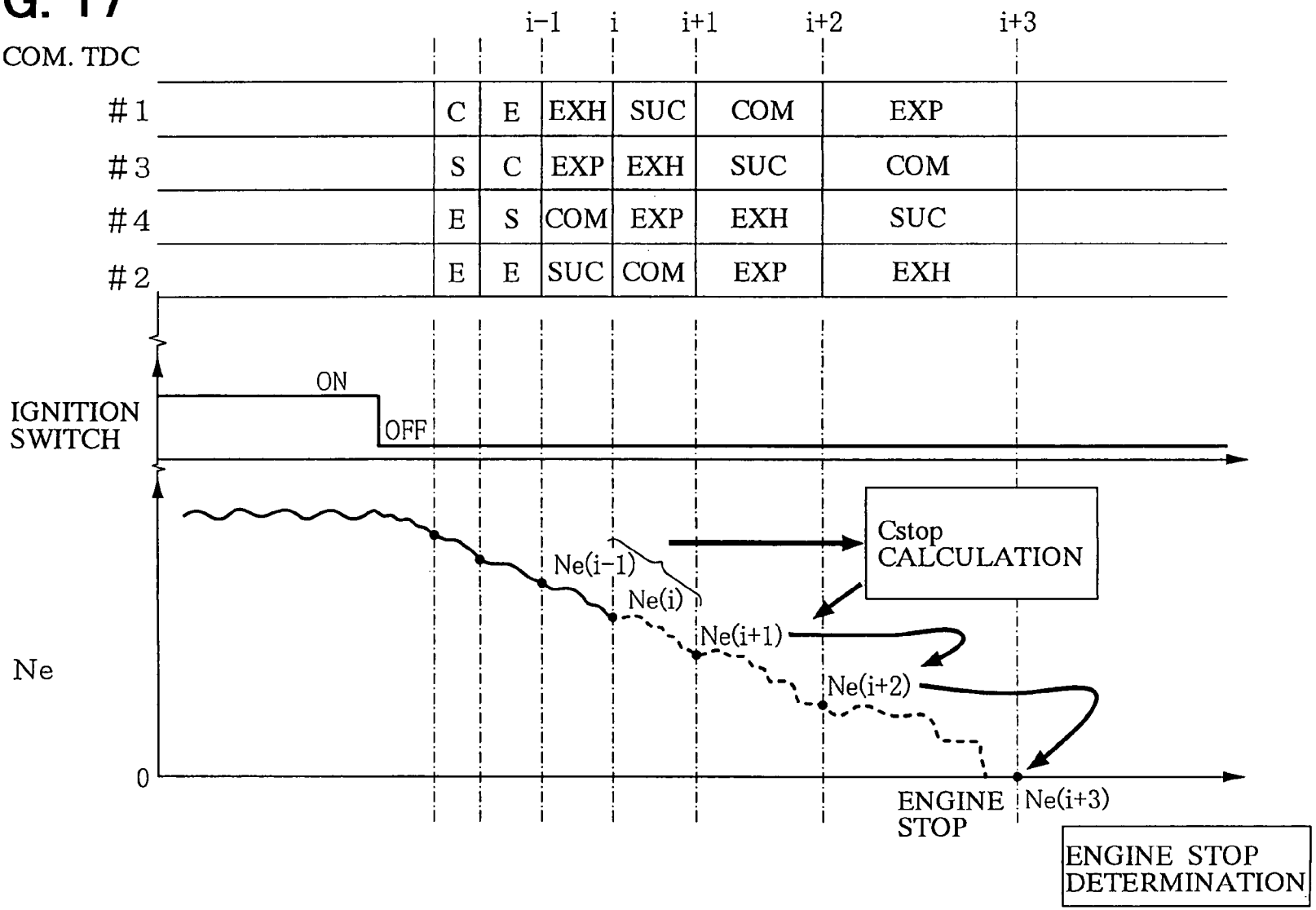
FIG. 17 is a time chart illustrating a method of estimating an engine rotation stop position according to a third embodiment of the present invention.

A method of estimating an engine rotation stop position, according to the third embodiment is described below with reference to a time chart shown in FIG. 17. A parameter Cstop for obstructing engine operations, and a predicted value of an instantaneous rotational speed Ne(i+1) at TDC (i+1) being the first in the future are calculated at TDC(i) in the course of engine stop in the same manner as in the second embodiment.

As described above, since a parameter Cstop for obstructing engine operations assumes a substantially constant value in the course of engine stop, a predicted value of an instantaneous rotational speed Ne(i+2) at TDC(i+2) being the second in the future is calculated by the following formulae (7a) and (7b) with the use of the Cstop and Ne(i+1), which have been calculated.

$$\text{When } Ne(i+1)^2 \geqq Cstop,\ Ne(i+2)=\sqrt{Ne(i+1)^2-Cstop} \tag{7a}$$

$$\text{When } Ne(i)^2 < Cstop,\ Ne(i+2)=0 \tag{7b}$$

In this manner, the processing of calculating a predicted value of an instantaneous rotational speed at TDC in the future is repeatedly executed until the predicted value of an instantaneous rotational speed falls below a stop determination value to estimate that engine rotation is stopped before TDC, at which the predicted value of an instantaneous rotational speed falls below the stop determination value.

Figure 18:
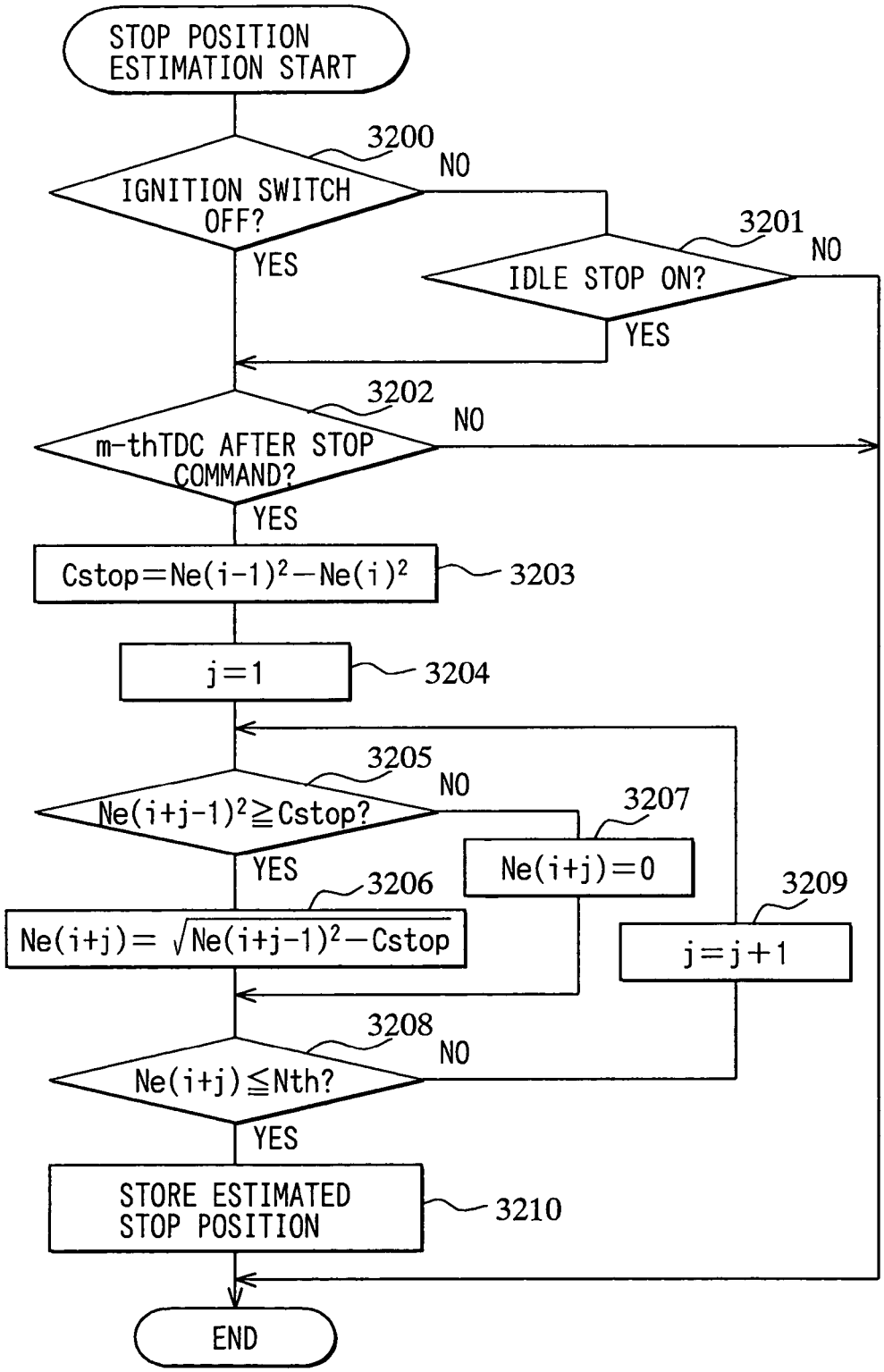
FIG. 18 is a flowchart illustrating processing in an engine rotation stop position estimation program according to the third embodiment.

Estimation of an engine rotation stop position according to the third embodiment is carried out by an engine rotation stop position estimation program shown in FIG. 18. The program is executed every TDC. When the program is started, it is first determined at step 3200 and step 3201 whether an engine stop command is generated (whether the IG switch is OFF, or the idling stop is ON), in the same manner as the second embodiment. When any engine stop command is not generated, it is determined that the engine is not in the course of stop. The program is terminated without performing estimation of any engine rotation stop position.

In contrast, when an engine stop command is generated, the processing proceeds to step 3202 to determine whether TDC is one of a predetermined time (for example, second time or third time) after an engine stop command is generated. When TDC is not one of a predetermined time, the program is terminated without performing estimation of an engine rotation stop position and standby is continued until TDC of a predetermined time is attained. In this manner, by continuing standby until TDC of a predetermined time is attained, a parameter Cstop for obstructing engine operations, which parameter is calculated in a subsequent step 3203, can be calculated in a stable state.

Then at a point of time, at which TDC of a predetermined time is attained after an engine stop command is generated, the processing proceeds to step 3203, in which a parameter Cstop for obstructing engine operations is calculated by the formula (5) with the use of an instantaneous rotational speed Ne(i−1) at TDC(i−1) at the last time and an instantaneous rotational speed Ne(i) at TDC(i) at present, in the same manner as the second embodiment.

Thereafter, the processing proceeds to step 3204 to set an initial value "1" to an estimated number-of-time counter j for counting an estimated number of times of an instantaneous rotational speed. Thereafter, an estimated value of an instantaneous rotational speed Ne(i+1) at TDC(i+1) being the first in the future is first calculated at step 3205, step 3206 and step 3207 in the same manner as the second embodiment.

Then whether engine rotation cannot pass the instantaneous rotational speed Ne(i+1), being the first in the future, to be stopped is determined in a subsequent step 3208 depending upon whether the predicted value of an instantaneous rotational speed Ne(i+1) being the first in the future falls below a stop determination value Nth. As a result, when it is determined that the predicted value of an instantaneous rotational speed Ne(i+1) being the first in the future exceeds the stop determination value Nth (the engine passes TDC (i+1), being the first in the future, to continue rotation), the processing proceeds to step 3209 to increase the estimated number-of-time counter j by only 1 and returns to the processing at step 3205, step 3206 and step 3207 to calculate a predicted value of an instantaneous rotational speed Ne(i+2) at TDC(i+2), being the second in the future, with the use of the predicted value of an instantaneous rotational speed Ne(i+1) being the first in the future and calculated at the last time, and a parameter Cstop for obstructing motions.

Thereafter, depending upon whether the predicted value of an instantaneous rotational speed Ne(i+2) being the second in the future falls below the stop determination value Nth, it is determined at step 3208 whether engine rotation cannot pass TDC(i+2), being the second in the future, to be stopped. As a result, when it is determined that the predicted value of an instantaneous rotational speed Ne(i+2) being the second in the future exceeds the stop determination value Nth (the engine passes TDC (i+2), being the second in the future, to continue rotation), the processing proceeds again to step 3209 to increase the estimated number-of-time counter j by only 1 and the processing, described above, at step 3205 to step 3209 are repeated.

In the above manner, calculation of a predicted value of an instantaneous rotational speed Ne(i+j) in the future is repeated until the value falls below the stop determination value Nth, and an instantaneous rotational speed Ne(i+j) in the future is successively estimated at TDC intervals.

Then at a point of time, at which a predicted value of a future instantaneous rotational speed Ne(i+j) falls below the stop determination value Nth, it is determined that engine rotation is stopped before TDC(i+j) of the instantaneous rotational speed Ne(i+j), and the processing proceeds to step 3210 to store a state of strokes of respective cylinders (for example, a suction stroke cylinders and compression-stroke cylinders) during an interval between TDC(i+j), at which stop is determined, and TDC(i+j−1) being the first in the past, as results of estimation of an engine rotation stop position, in the backup RAM 32. For example, when an instantaneous rotational speed Ne(i+3) at TDC(i+3) being the third in the future falls below the stop determination value Nth, it is determined that engine rotation is stopped during an interval between TDC(i+2) being the second in the future and TDC(i+3) being the third in the future. The state of strokes of respective cylinders during an interval between TDC(i+2) and TDC(i+3) is stored as results of estimation of an engine rotation stop position.

In the third embodiment, it is advantageous that the processing of estimating a further future instantaneous rotational speed Ne(i+j+1) can be repeated any number of times, until it is determined that engine rotation is stopped, with the use of a predicted value of an instantaneous rotational speed Ne(i+j) in the future and a parameter Cstop for obstructing motions. Thus, estimation of an engine rotation stop position can be carried out early in the course of engine stop.

(Fourth Embodiment)

In the second and the third embodiment, an instantaneous rotational speed in the future is estimated, and whether engine rotation is stopped is determined depending upon whether a predicted value of the instantaneous rotational speed falls below a preset stop determination value. In the case where an instantaneous rotational speed in the future is not estimated, an engine rotation stop position may be estimated by calculating an engine stop determination value on the basis of a parameter for obstructing engine operations, and making a comparison between an instantaneous rotational speed actually measured in the course of engine stop and the engine stop determination value.

Figure 19:
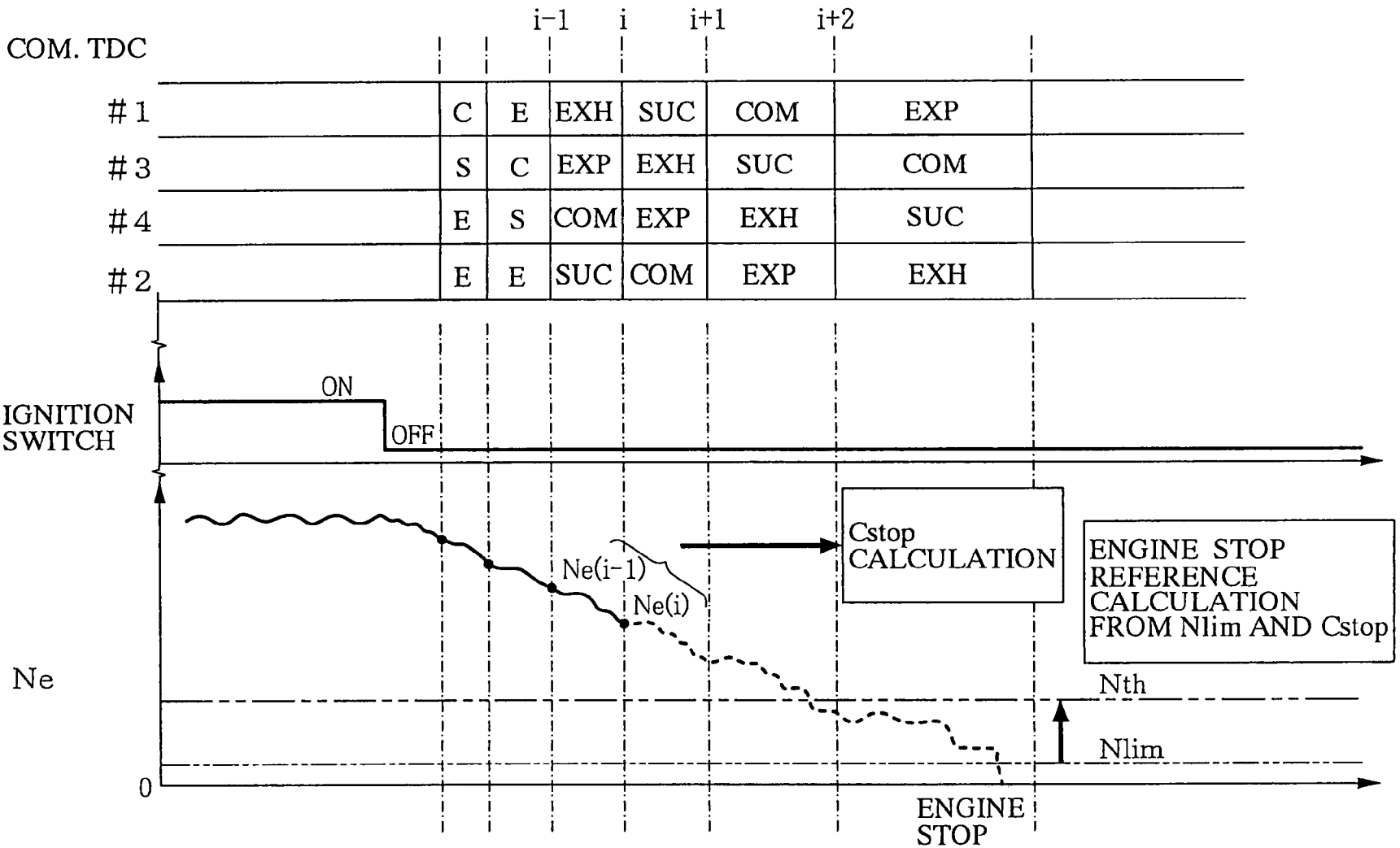
FIG. 19 is a time chart illustrating a method of estimating an engine rotation stop position, according to a fourth embodiment of the present invention.

First, a method of estimating an engine rotation stop position, according to the fourth embodiment, is described below with reference to a time chart shown in FIG. 19. A parameter Cstop for obstructing engine operations is calculated at TDC(i) in the course of engine stop in the same manner as in the second and third embodiments. An engine stop determination value Nth with respect to whether an engine is stop until a subsequent TDC is calculated by the following formula (8) with the use of the parameter Cstop and a TDC passing critical rotational speed Nlim having been preset. At a point of time, at which an instantaneous rotational speed actually measured in the course of engine stop falls below the engine stop determination value Nth, it is determined that an engine is stop until a subsequent TDC, and a state of strokes of respective cylinders in an engine rotation stop position is estimated, results of which are stored in the backup RAM 32.

$$Nth=\sqrt{Nlim^2+Cstop} \tag{8}$$

Figure 20:
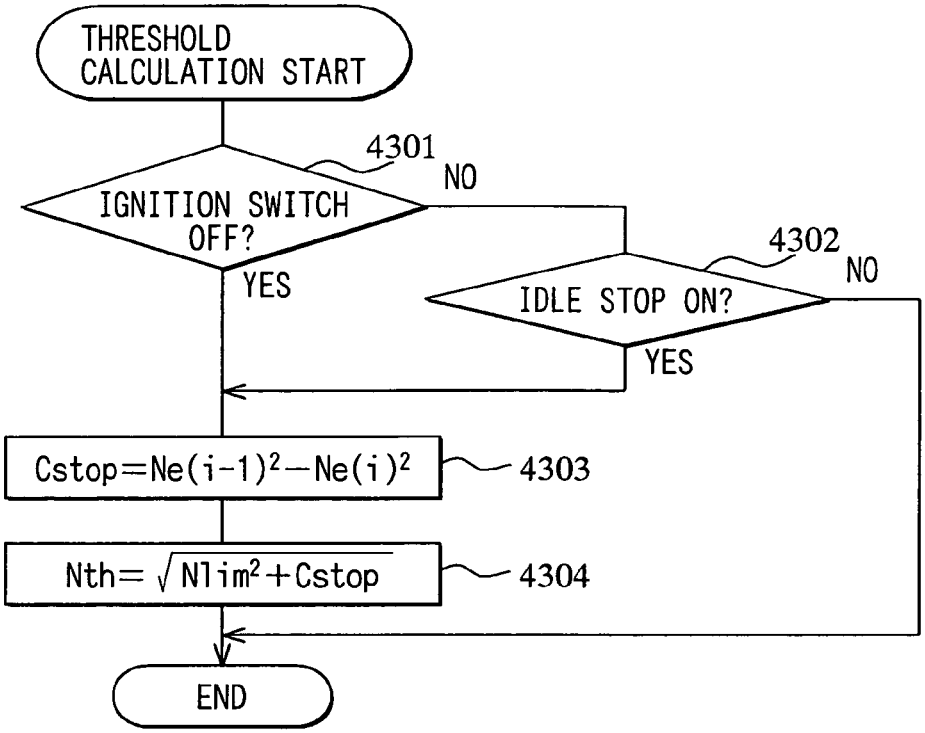
FIG. 20 is a flow chart illustrating processing in an engine stop determination value calculation program according to the fourth embodiment.
Figure 21:
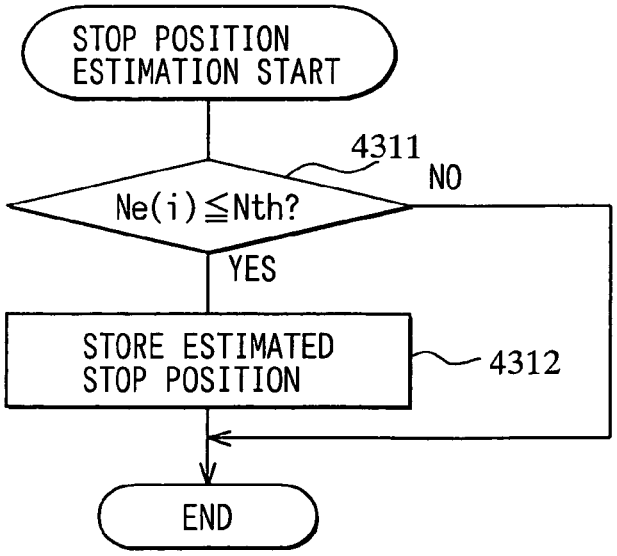
FIG. 21 is a flowchart illustrating processing in an engine rotation stop position estimation program according to the fourth embodiment.

Estimation of an engine rotation stop position according to the fourth embodiment, is carried out by respective programs shown in FIGS. 20 and 21. Contents of processing in the respective programs are described below.

An engine stop determination value calculation program shown in FIG. 20 is executed every TDC. When the program is started, it is first determined at step 4301 and step 4302 whether an engine stop command is generated (whether the IG switch is OFF, or the idling stop is ON), in the same manner as the second embodiment. When any engine stop command is not generated, it is determined that the engine is not in the course of stop, and the program is terminated without performing estimation of any engine stop determination value Nth.

In contrast, when an engine stop command is generated, the processing proceeds to step 4303, in which a parameter Cstop for obstructing engine operations is calculated by the formula (5) with the use of an instantaneous rotational speed Ne(i−1) actually measured at TDC(i−1) at the last time and an instantaneous rotational speed Ne(i) actually measured at TDC(i) at present.

Thereafter, the processing proceeds to step 4304, in which an engine stop determination value Nth with respect to whether an engine is stop is calculated by the formula (8) with the use of a preset value Nlim as a critical rotational speed, which cannot pass TDC, and the parameter Cstop, calculated at step 4303, for obstructing engine operations, and the program is terminated.

An engine rotation stop position estimation program shown in FIG. 21 is started whenever an engine stop determination value Nth is calculated at step 4304 shown in FIG. 20. When the program is started, a comparison is first made at step 4311 between an actual measurement value of an instantaneous rotational speed Ne(i) at present and an engine stop determination value Nth calculated at step 4304. When the actual measurement value of the instantaneous rotational speed Ne(i) at present exceeds the engine stop determination value Nth, it is determined that the engine passes a subsequent TDC(i+1) to continue rotation, and the program is terminated.

In contrast, when the actual measurement value of the instantaneous rotational speed Ne(i) at present falls below the engine stop determination value Nth, it is determined that engine rotation is stopped before a subsequent TDC(i+1). The processing proceeds to step 4312 to store a state of strokes of respective cylinders during an interval between TDC(i) at present and a subsequent TDC(i+1), as results of estimation of an engine rotation stop position, in the backup RAM 32.

In the fourth embodiment, since the engine stop determination value Nth is calculated with the use of the parameter Cstop for obstructing engine operations, variation due to manufacturing tolerance of engines, changes with the passage of time, and changes in engine friction (for example, a difference in viscosity due to temperature change of an engine oil) can be reflected on the engine stop determination value Nth, so that an engine rotation stop position can be accurately estimated even when an instantaneous rotational speed in the course of engine stop is not estimated.

In addition, while an engine rotational speed (instantaneous rotational speed) is used as a parameter indicative of engine operations in the second, third, and fourth embodiments, a crankshaft angular velocity, a traveling speed of pistons, or the like may be used.

(Fifth Embodiment)

Figure 22:
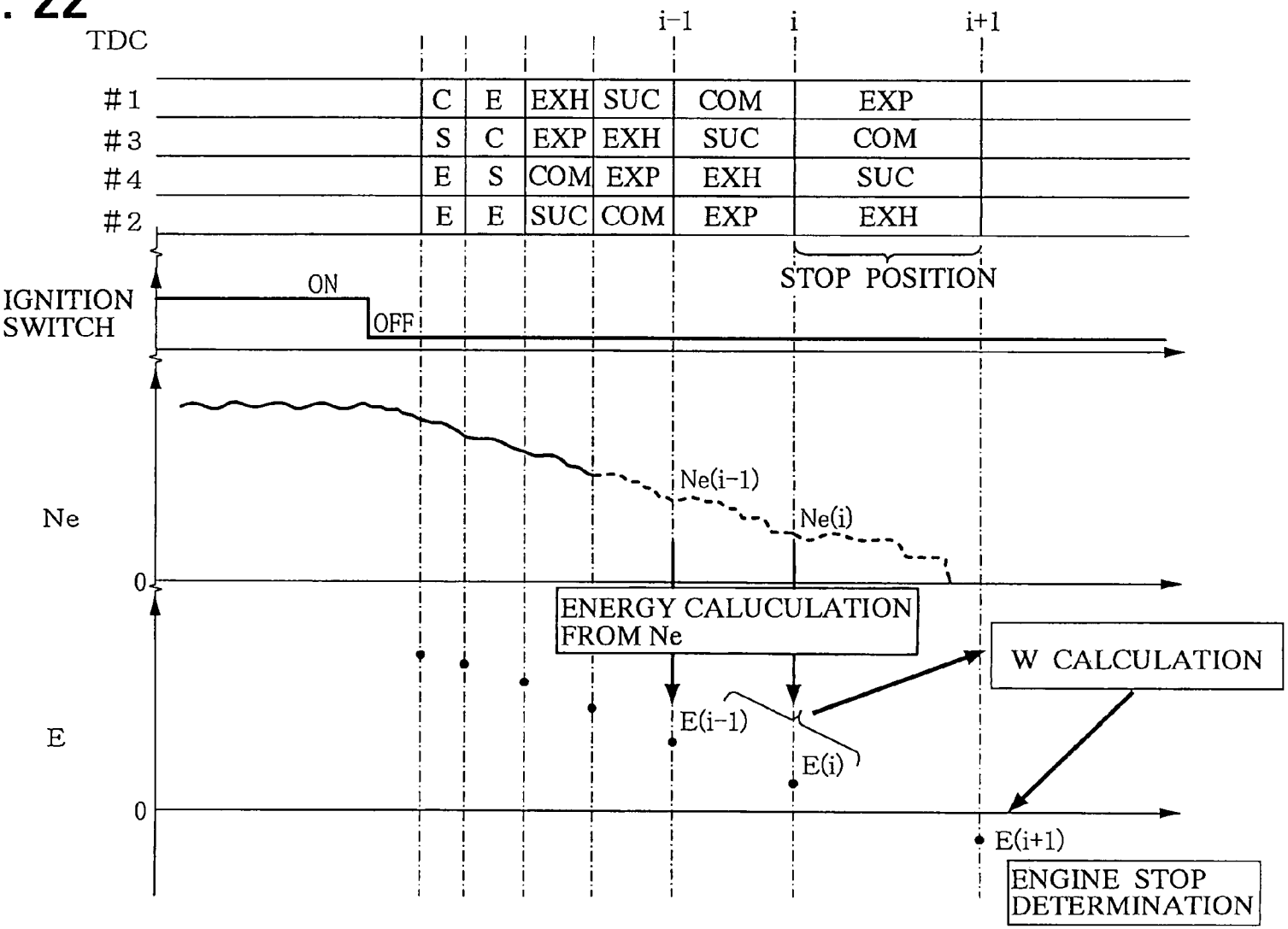
FIG. 22 is a time chart illustrating a method of estimating an engine rotation stop position according to a fifth embodiment of the present invention.

Also, kinetic energy may be used as a parameter indicative of engine operations. The fifth embodiment for embodying this is described below with reference to a time chart shown in FIG. 22. Making use of instantaneous rotational speeds Ne(i−1) and Ne(i), which are actually measured at TDC(i−1) at the last time and TDC(i) at present, and moment of inertia J of an engine previously calculated, kinetic energy E(i−1), E(i) at TDC(i−1) and TDC(i) are calculated by the formula (2). In the fifth embodiment, the kinetic energy E is used as a parameter indicative of engine operations.

When pumping loss, friction loss in respective parts, and driving loss in respective auxiliary devices are taken into account as work for obstructing engine operations in the same manner as in the second to fourth embodiments, a whole work load generated between TDC(i−1) and TDC(i) to obstruct engine operations can be found as a difference between kinetic energy E(i−1) and E(i) at TDC(i−1) and TDC(i) by the following formula (9).

$$W=E(i-1)-E(i) \tag{9}$$

In the fifth embodiment, the work load W for obstructing engine operations is used as a parameter indicative of engine operations.

As described above, pumping loss, friction loss in respective parts, and driving loss in respective auxiliary devices, which are taken into account as work for obstructing motions, are substantially constant irrespective of rotational speed in the course of engine stop. Accordingly, the work W for obstructing motions assumes a substantially constant value in an interval between any TDCs in the course of engine stop. Accordingly, making use of kinetic energy E(i) of an engine at present and the work W for obstructing motions, a predicted value of kinetic energy E(i+1) at TDC(i+1) being the first in the future can be calculated by the following formula (10).

$$E(i+1)=E(i)-W \tag{10}$$

In the fifth embodiment, a comparison is made between a predicted value of kinetic energy E(i+1) of an engine at TDC(i+1) in the future and a stop determination value Eth to determine whether engine rotation is stopped to estimate a state of strokes of respective cylinders in an engine rotation stop position.

Figure 23:
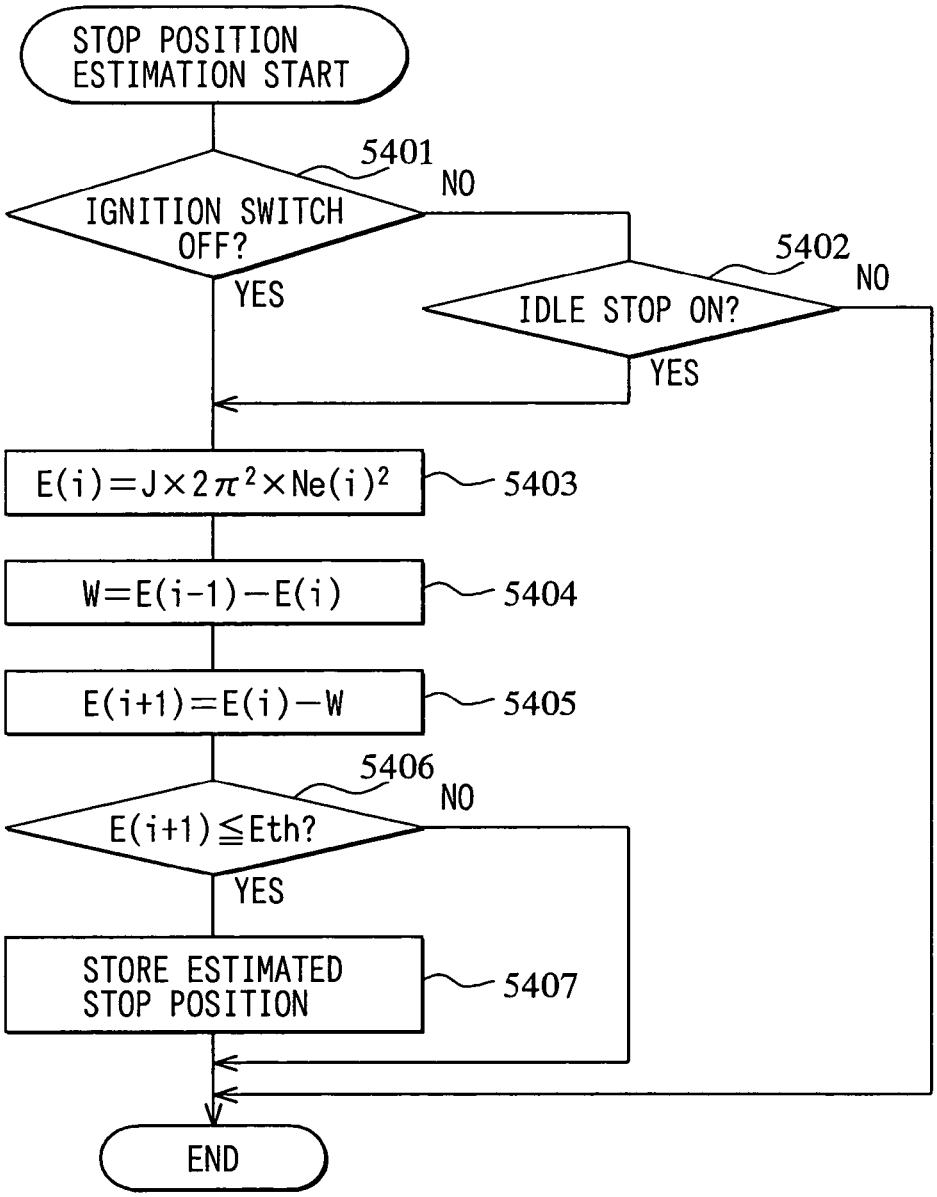
FIG. 23 is a flow chart illustrating processing in an engine rotation stop position estimation program according to the fifth embodiment.

Estimation of an engine rotation stop position, described above, in the fifth embodiment is executed by an engine rotation stop position estimation program shown in FIG. 23. This program is executed every TDC. When the program is started, it is first determined at step 5401 and step 5402 whether an engine stop command is generated (whether the IG switch is OFF, or the idling stop is ON), in the same manner as the second embodiment. When any engine stop command is not generated, it is determined that the engine is not in the course of stop, and the program is terminated without performing estimation of any engine rotation stop position.

In contrast, when an engine stop command is generated, the processing proceeds to step 5403, in which kinetic energy E(i) at TDC(i) at present is calculated by the formula (2) with the use of an actual measurement value of an instantaneous rotational speed Ne(i) at TDC(i) at present and moment of inertia J of an engine previously calculated.

Thereafter, the processing proceeds to step 5404, in which a difference between kinetic energy E(i−1) calculated at TDC(i−1) at the last time and E(i) calculated at TDC(i) at present is used to find a work load W for obstructing engine operations. Then a difference between kinetic energy E(i) at present and the work load W for obstructing engine operations is found in a subsequent step 5405 to calculate a predicted value of kinetic energy E(i+1) at TDC(i+1) being the first in the future.

Thereafter, the processing proceeds to step 5406 to make a comparison between the predicted value of kinetic energy E (i+1) at TDC(i+1) being the first in the future and a preset stop determination value Eth to determine whether engine rotation should pass TDC(i+1) to proceed to a subsequent process, or cannot pass TDC(i+1) to be stopped. That is, when kinetic energy E(i+1) at TDC(i+1) being the first in the future exceeds the stop determination value Eth, it is determined that the engine passes TDC(i+1), being the first in the future, to continue rotation, and the program is terminated.

In contrast, when kinetic energy E(i+1) at TDC(i+1) being the first in the future falls below the stop determination value Eth, it is determined that engine rotation cannot pass a subsequent TDC(i+1) to be stopped, and the processing proceeds to step 5407.

At step 5407, since it is estimated that the engine is stop between TDC(i) at present and a subsequent TDC(i+1), information of a state of strokes of respective cylinders (for example, a suction stroke cylinders and compression-stroke cylinders) in the engine rotation stop position is stored as results of estimation of an engine rotation stop position in the backup RAM 32, and the program is terminated.

As in the fifth embodiment, an engine rotation stop position can be accurately estimated in the same manner as the second to fourth embodiments even when kinetic energy is used as a parameter indicative of engine operations and a total amount of work load for obstructing motions is used as a parameter for obstructing engine operations.

In addition, while an instantaneous rotational speed calculated from a period of time required in output intervals (for example, 30° CA) of crank angle signals CRS in the second to fifth embodiments, a rotational speed calculated in other methods may be used.

Also, while calculation of an estimated engine rotation stop position is carried out every TDC, any crank angle may be made a timing of calculation provided that calculation is carried out at an interval obtained by dividing 720° CA by the number of cylinders of an engine.

Also, while a state of strokes of respective cylinders (for example, a suction stroke cylinders and compression-stroke cylinders) at the time of engine stop is stored as results of estimation of an engine rotation stop position, for example, a range of a crank angle in an engine rotation stop position may be stored.

Also, while stop determination values Nth, Eth are fixed value as preset in the second, third and fifth embodiments, stop determination values Nth, Eth may be calculated on the basis of the parameter Cstop for obstructing engine operations, in these embodiments in the same manner as in the fourth embodiment.

(Sixth Embodiment)

A sixth embodiment, in which the present invention is applied to estimation of an engine rotational speed decreasing in the course of stop, is described below with reference to FIGS. 24 to 27. In addition, estimation of an engine rotational speed in the sixth embodiment is used for estimation of a cylinder or cylinders in the compression stroke when an engine stops.

Figure 24:
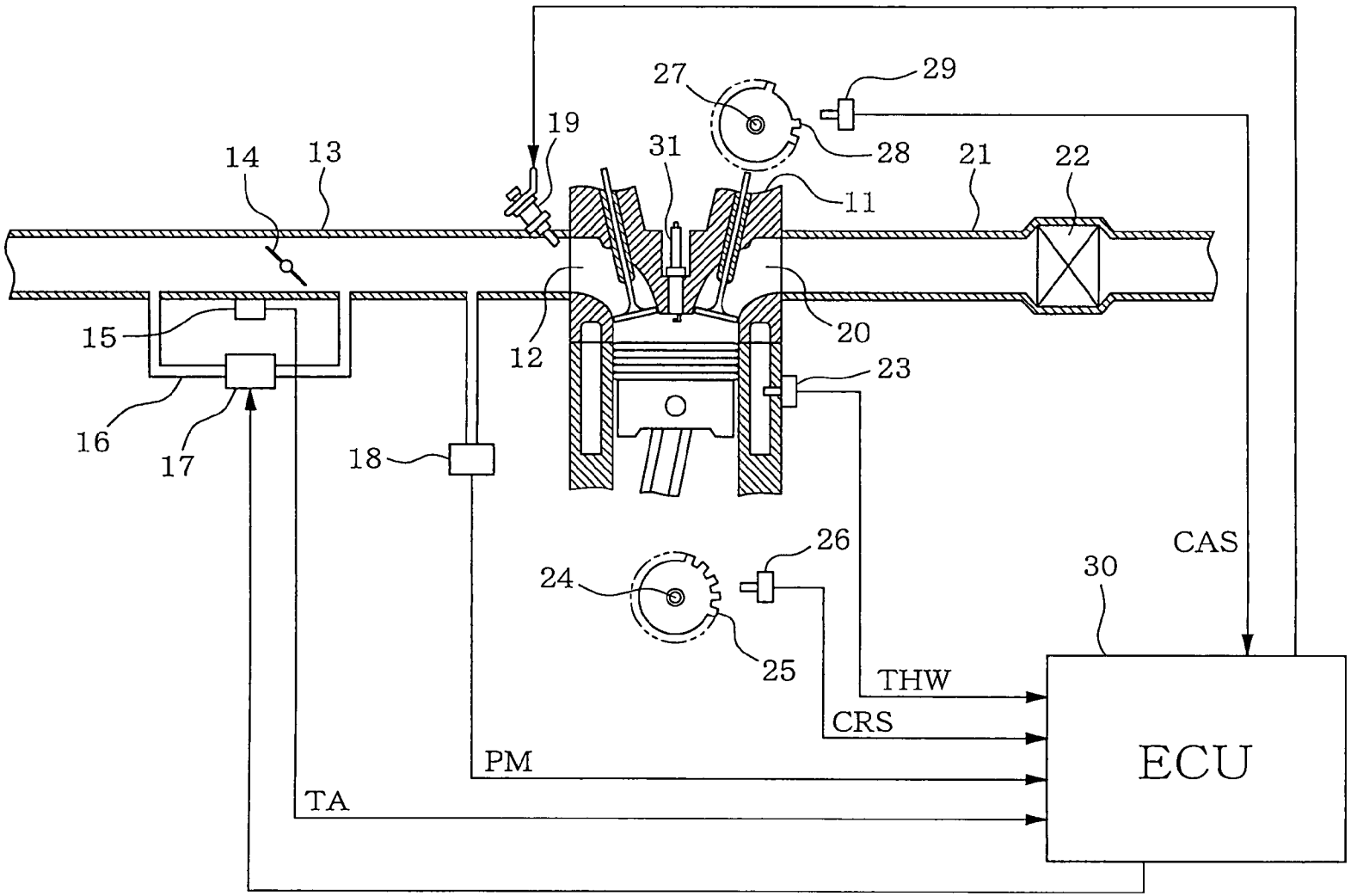
FIG. 24 is a schematic diagram illustrating an engine control system in a sixth embodiment of the present invention.

An engine control system according to the sixth embodiment is also configured, as shown in FIG. 24, in the same manner as other embodiments (FIGS. 1 and 11).

Figure 25:
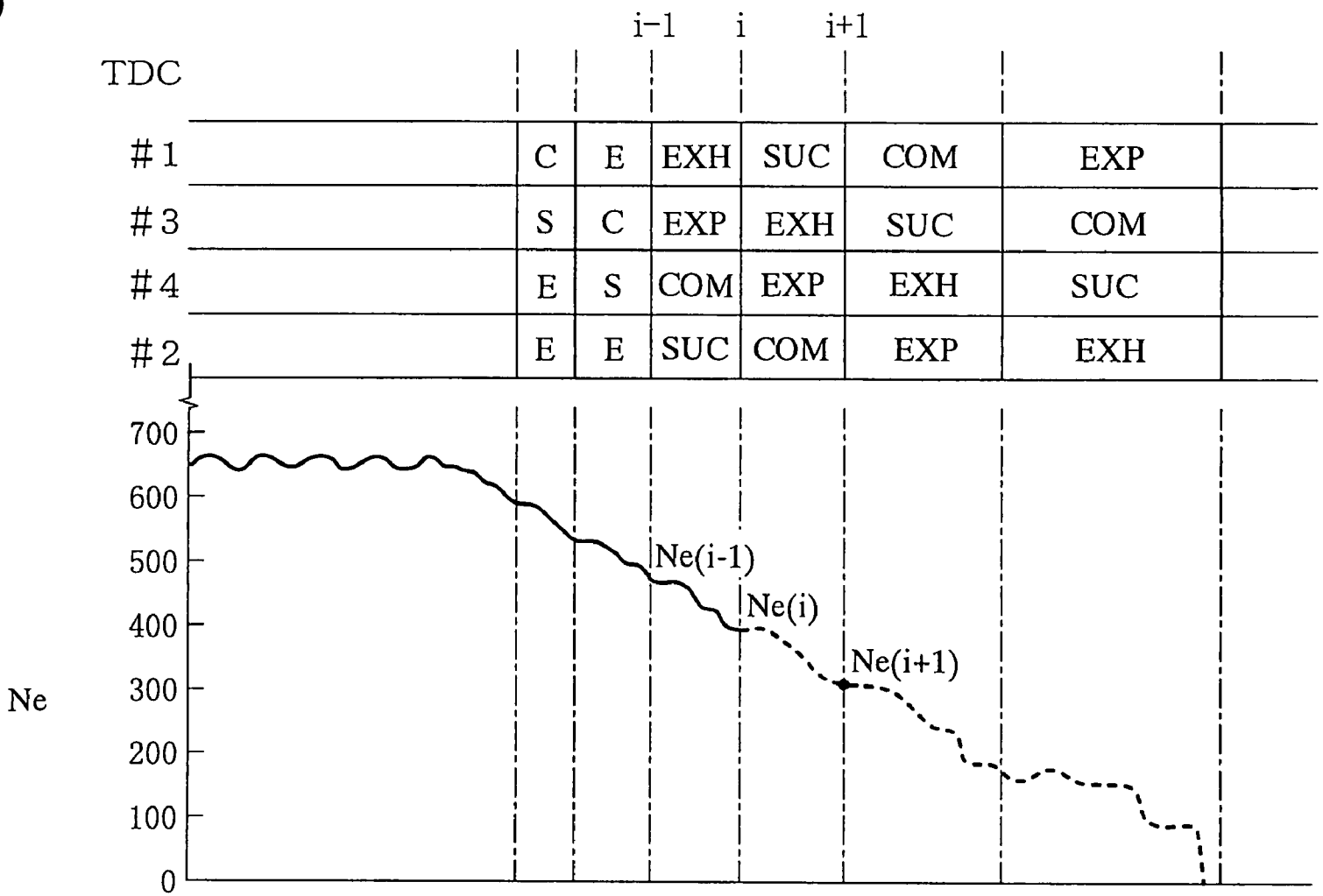
FIG. 25 is a time chart illustrating the change of an engine rotational speed and timings of estimation of kinetic energy.

According to the sixth embodiment, kinetic energy in the future and an engine rotational speed in the future are estimated as indicated by a time chart shown in FIG. 25. At respective TDCS, kinetic energy E is calculated by the following formula (11). An engine rotational speed is estimated at (i+1)th TDC by estimating kinetic energy, at (i+1)th being the first in the past, at i-th TDC and further converting the same into an engine rotational speed.

$$E=J\times 2\pi^2\times Ne^2 \tag{11}$$

Here, E indicates kinetic energy at TDC, and J indicates moment of inertia determined every engine, for which a value previously calculated by compatibility or the like is used. Ne indicates an instantaneous engine rotational speed at TDC.

Figure 26:
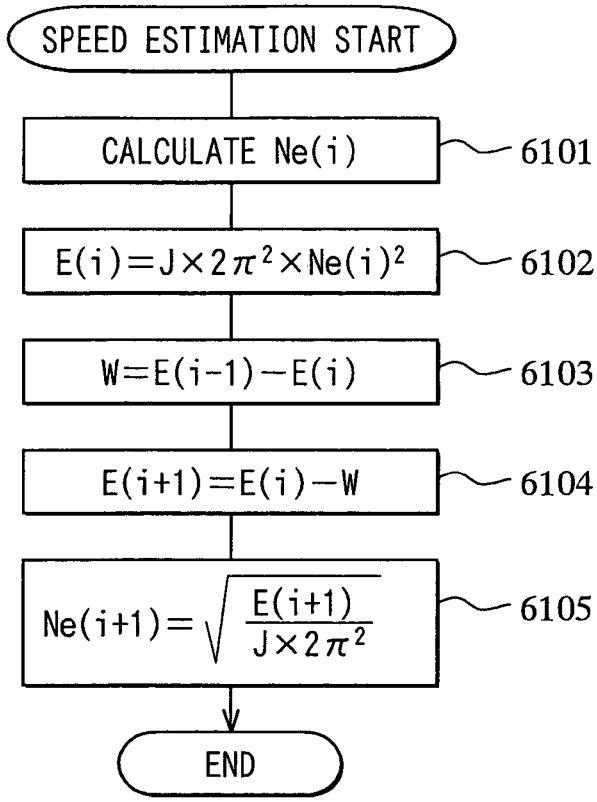
FIG. 26 is a flow chart illustrating processing in an engine rotational speed estimation program according to the sixth embodiment.

Such estimation of an engine rotational speed is executed in accordance with an engine rotational speed estimation program shown in FIG. 26. The program is executed repeatedly every TDC. When the program is started, an instantaneous rotational speed Ne(i) at TDC at present is calculated from crank angle signals CRS at step 6101, and the formula (11) is used in a subsequent step 6102 to calculate kinetic energy E(i) at TDC at present. The processing at step 6102 serves as kinetic energy calculation means.

Thereafter, the processing proceeds to step 6103 to use the following formula (12) to calculate a work load W for obstructing motions. In the sixth embodiment, being conditions in the course of engine stop, pumping loss, friction loss in respective parts, and driving loss in respective auxiliary devices are taken into account as a work load W for obstructing motions.

$$W=E(i-1)-E(i) \tag{12}$$

Here, E(i−1) indicates kinetic energy calculated by the formula (11) at TDC being in the first stroke in the past. The processing at step 6103 serves as work load calculation means. In this case, since only work for obstructing motions is a factor for reduction of kinetic energy, a work load W is found by a difference between kinetic energy E(i−1) being in the first stroke in the past and a present kinetic energy E(i).

Figure 27:
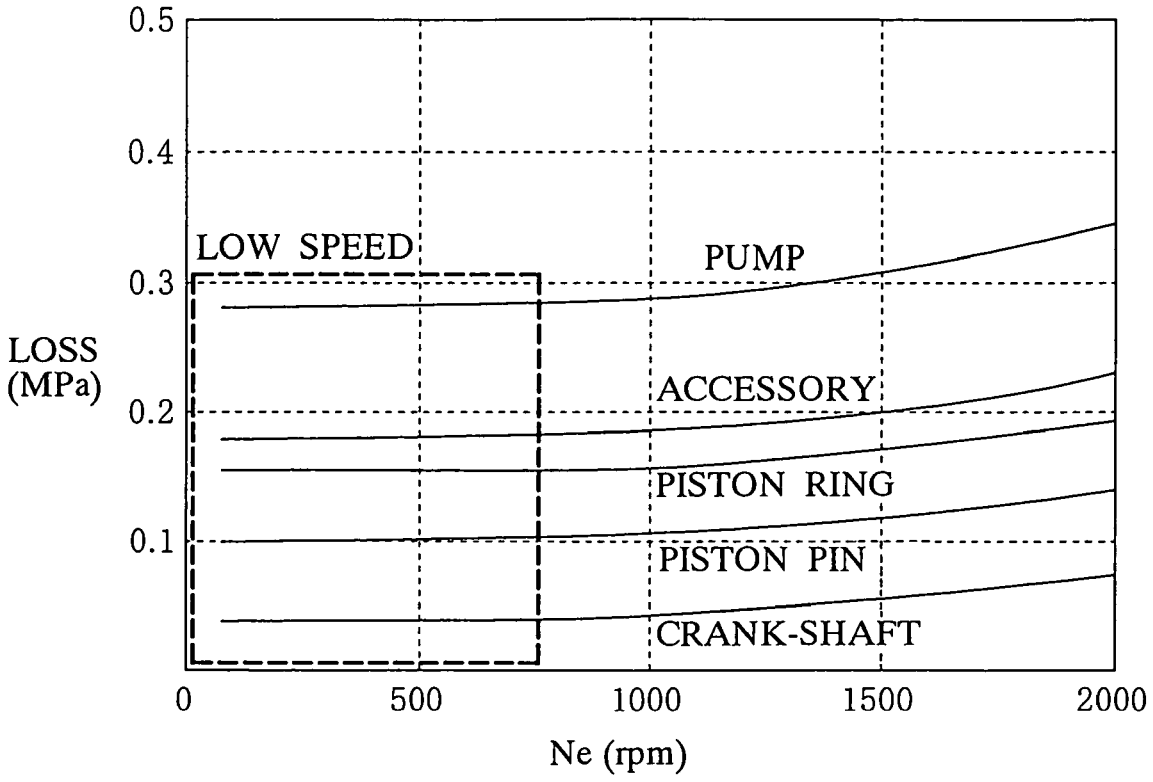
FIG. 27 is a diagram illustrating the relationship between an engine rotational speed and magnitudes of various losses in a gasoline engine.

Under operating conditions of low revolution as in the course of engine stop, pumping loss, friction loss in respective parts, and driving loss in respective auxiliary devices, which are taken into account as a work load W for obstructing motions, assume substantially constant values irrespective of engine rotational speed as shown in FIG. 27. Accordingly, kinetic energy, which the engine 11 has at TDC in the first stroke in the future, is reduced by a work load W, calculated at step 6103, for obstructing motions. Hereupon, the following formula (13) is used at step 6104 to calculate a predicted value E(i+1) of kinetic energy at TDC in the first stroke in the future.

$$E(i+1)=E(i)-W \tag{13}$$

The processing at step 6104 serves as future kinetic energy calculation means.

Then the following formula (14) obtained by modification of the formula (11) is used in a subsequent step 6105 to calculate an instantaneous rotational speed Ne(i+1) at TDC in the first stroke in the future.

$$Ne(i+1)=\sqrt{\frac{E(i+1)}{J\times 2\pi^2}} \tag{14}$$

The processing at step 6105 serves as rotational speed estimation means.

The above processing makes it possible to estimate a future kinetic energy, which the engine 11 has, and to estimate a future engine rotational speed from the predicted value of kinetic energy.

In addition, while the sixth embodiment has been illustrated with respect to the case in the course (a region of low revolution) of engine stop, during which losses taken into account as a work load for obstructing motions assume substantially constant values, a parameter or parameters having an influence on changes in losses are used to effect correction to enable estimating a future kinetic energy irrespective of a region of rotational speed even in the case where losses taken into account as a work load for obstructing motions are varied as in the course of a decrease in engine rotational speed from regions of high/middle revolution in, for example, fuel cut-off, or the like.

Also, while an engine rotational speed is used for calculation of kinetic energy, a value related to other rotational speeds, such as a crankshaft angular velocity and a traveling speed of pistons, in an internal combustion engine may be used for calculation.

Also, while an explanation has been given in the course of engine stop, during which combustion in the engine 11 is stopped, a future kinetic energy may be estimated in an operation of an engine, in which combustion occurs, by adding means for estimating energy obtained by combustion, to means for calculating a present kinetic energy, and means for calculating a work load, which obstructs motions. At this time, energy obtained by combustion may be estimated by taking account of inner cylinder pressures in respective cylinders, intake pipe pressure, intake air quantity, throttle opening, fuel injection quantity, ignition timing, air-fuel ratio, or the like.

Also, while kinetic energy in the first stroke in the future is estimated on the basis of a present kinetic energy as calculated and a work load for obstructing motions, a further future kinetic energy may be estimated on the basis of a future kinetic energy as estimated and a work load for obstructing motions.

Also, while a predicted value of kinetic energy in the first stroke in the future is estimated by calculating kinetic energy, calculating a work load for obstructing motions, and estimating a future kinetic energy at a timing every TDC, such timing for calculation/estimation, and a period of time for estimation are not limited to every TDC and every one stroke but any timing and any period of time may do.

(Seventh Embodiment)

Figure 28:
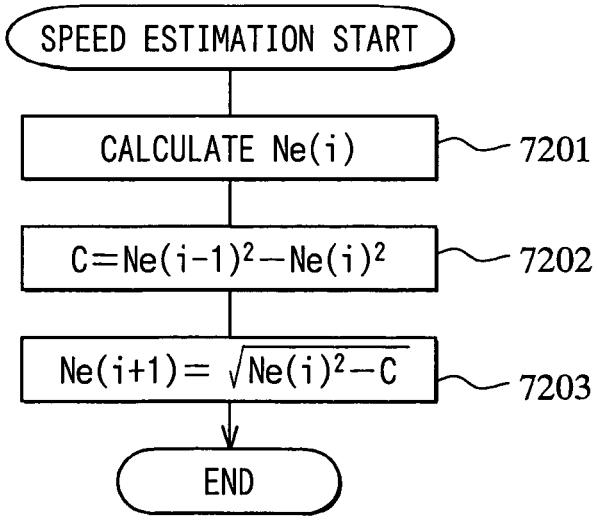
FIG. 28 is a flow chart illustrating processing in an engine rotational speed estimation program according to a seventh embodiment of the present invention.

According to the seventh embodiment, a future engine rotational speed is estimated in accordance with an engine rotational speed estimation program shown in FIG. 28 without the use of moment of inertia J.

The formula (11) being an kinetic energy calculation formula is used to modify the formula (12), which is one for calculation of a work load for obstructing motions, to provide the following formula (15).

$$\frac{W}{J \times 2\pi^2} = Ne(i-1)^2 - Ne(i)^2 \tag{15}$$

The left term of the formula (15) is a quantity C representative of rotational speed reduction and defined as the following formula (16).

$$C = \frac{W}{J \times 2\pi^2} \tag{16}$$

A rotational speed reduction C is calculated by the use of the following formula (17), which is obtained by substituting the formula (16) for the formula (15).

$$C = Ne(i-1)^2 - Ne(i)^2 \tag{17}$$

Here, Ne(i) indicates an instantaneous rotational speed at TDC at present, and Ne(i−1) indicates an instantaneous rotational speed at TDC in the first stroke in the past.

As described above, under operating conditions of low revolution as in the course of engine stop, a work load W for obstructing motions can be regarded as assuming a constant value. Also, since moment of inertia J assumes a constant value peculiar to every engine, a rotational speed reduction C defined by the formula (16), assumes a constant value irrespective of engine rotational speed. Accordingly, an instantaneous rotational speed Ne(i+1) at TDC in the first stroke in the future is reduced by the rotational speed reduction C calculated by the formula (16).

The following formula (18) is used to calculate a predicted value Ne(i+1) of an instantaneous rotational speed at TDC in the first stroke in the future.

$$Ne(i+1) = \sqrt{Ne(i)^2 - C} \tag{18}$$

Calculation of a predicted value Ne(i+1) of an instantaneous rotational speed described above is repeatedly carried out every TDC in accordance with the engine rotational speed estimation program shown in FIG. 28. When the program is started, an instantaneous rotational speed Ne(i) at TDC at present is calculated from crank pulse signals CRS at step 7201. Thereafter, the processing proceeds to step 7202 to use the formula (17) to calculate a rotational speed reduction C, and then proceeds to step 7203 to use the formula (18) to calculate a predicted value Ne(i+1) of an instantaneous rotational speed at TDC in the first stroke in the future.

Since a method of calculating a predicted value Ne(i+1) of an instantaneous engine rotational speed in the seventh embodiment enables calculating a predicted value Ne(i+1) of an instantaneous engine rotational speed from only an instantaneous rotational speed Ne(i) at TDC at present and an instantaneous rotational speed Ne(i−1) at TDC in the first stroke in the past without the use of moment of inertia J peculiar to an engine, man-hour for finding moment of inertia J peculiar to an engine by compatibility or the like becomes unnecessary to produce an advantage that development time can be shortened.

Besides, the number of calculation required until an instantaneous engine rotational speed in the future is estimated can be reduced, and load of calculation on CPU of the ECU 30 can be decreased. Also, since moment of inertia J found by compatibility or the like is not used, an instantaneous engine rotational speed in the future can be estimated further accurately without being affected by fabrication tolerance every engine.

In addition, the formula (17) may be substituted for the right term of the formula (18) to modify the formula (18) into the following formula (19), and the formula (19) may be used to calculate a predicted value Ne(i+1) of an instantaneous engine rotational speed from only an instantaneous rotational speed Ne(i) at present and an instantaneous rotational speed Ne(i−1) in the first stroke in the past without calculating a rotational speed reduction C.

$$Ne(i+1) = \sqrt{2Ne(i)^2 - Ne(i-1)^2} \tag{19}$$

While an engine rotational speed in the future is estimated in the sixth and seventh embodiments described above, the same method may be used to estimate other values related to rotational speeds, such as a crankshaft angular velocity and a traveling speed of pistons, in an internal combustion engine.

Also, while a value taking account of moment of inertia J is used as a rotational speed reduction C (variation of a value related to rotational speed) in the seventh embodiment, a value taking account of mass of portions related to rotation, such as a total of mass of a piston, a connecting rod, and a crankshaft, and a diameter of rotational motions, such as a radius of a crankshaft, may be used as variation of a value related to rotational speed.

Further, the present invention is not limited to four-cylinder engines but can be embodied in application to three or less-cylinder engines, or five or more-cylinder engines, and the present invention is not limited to intake-port injection engines as shown in FIG. 1 but can be embodied in application to in-cylinder injection engines and lean-burn engines.

What is claimed is:

1. An engine rotation stop position control apparatus comprising:

engine stop means for stopping at least one of ignition and fuel injection on the basis of an engine stop command to stop engine rotation;

first parameter calculation means for calculating a parameter representative of engine operations, second parameter calculation means for calculating a parameter which obstructs engine operations; and rotation stop position estimation means for estimating an engine rotation stop position in the course, in which the engine stop means stops engine rotation, on the basis of the parameter representative of engine operations and the parameter for obstructing the engine operations, which are calculated by the first parameter calculation means and the second parameter calculation means.

2. The engine rotation stop position control apparatus according to claim 1, wherein the engine stop command is generated by either of an ignition switch OFF signal and an idling stop ON signal.

3. The engine rotation stop position control apparatus according to claim 1, wherein the first parameter calculation means calculates at least one of kinetic energy of an engine, rotational speed, crankshaft angular velocity, and piston traveling speed, as the parameter representative of motions.

4. The engine rotation stop position control apparatus according to claim 1, wherein the first parameter calculation means calculates the parameter representative of motions every crank angle part obtained by dividing 720° CA by the number of cylinders of the engine.

5. The engine rotation stop position control apparatus according to claim 1, wherein the first parameter calculation means calculates an instantaneous value at a timing of calculation.

6. The engine rotation stop position control apparatus according to claim 1, wherein the second parameter calculation means calculates at least one of pumping loss, friction loss in respective parts, and driving loss in respective auxiliary devices, as the parameter for obstructing motions.

7. The engine rotation stop position control apparatus according to claim 6, wherein the second parameter calculation means calculates the parameter for obstructing motions, taking into account at least one of mass of and a diameter of rotational motions of portions related to engine operations and moment of inertia of an engine.

8. The engine rotation stop position control apparatus according to claim 6, wherein the second parameter calculation means calculates the parameter for obstructing motions, at least once in the course, in which the engine stops rotation.

9. The engine rotation stop position control apparatus according to claim 1, wherein the second parameter calculation means calculates a quantity, by which engine operations are obstructed, on the basis of that parameter representative of motions, which is calculated this time by the first parameter calculation means, and the parameter representative of motions, which is calculated at the last time.

10. The engine rotation stop position control apparatus according to claim 1, wherein the second parameter calculation means calculates a quantity, by which engine operations are obstructed, in a crank angle obtained by dividing 720° CA by the number of cylinders of the engine.

11. The engine rotation stop position control apparatus according to claim 1, wherein the rotation stop position estimation means estimates a parameter representative of future motions on the basis of that parameter representative of motions, which is calculated this time by the first parameter calculation means, and the parameter for obstructing motions, and estimates an engine rotation stop position on the basis of a predicted value of the parameter representative of future motions.

12. The engine rotation stop position control apparatus according to claim 11, wherein the rotation stop position estimation means estimates a parameter representative of motions in the future by that part of a crank angle, which is obtained by dividing 720° CA by the number of cylinders of the engine.

13. The engine rotation stop position control apparatus according to claim 11, wherein the rotation stop position estimation means estimates a parameter representative of further future motions on the basis of a predicted value of the parameter representative of future motions and the parameter for obstructing motions.

14. The engine rotation stop position control apparatus according to claim 11, wherein the rotation stop position estimation means estimates that engine rotation is stopped this side of a crank angle of the predicted value when a predicted value of the parameter representative of future motions falls below a predetermined value.

15. The engine rotation stop position control apparatus according to claim 1, wherein the rotation stop position estimation means calculates an engine stop determination value on the basis of that parameter for obstructing motions, which is calculated by the second parameter calculation means, and makes a comparison between that parameter representative of motions, which is calculated by the first parameter calculation means, in the course, in which the engine stop means stops engine rotation, to estimate an engine rotation stop position.

* * * * *